US006925348B2

(12) United States Patent
Kistler et al.

(10) Patent No.: US 6,925,348 B2
(45) Date of Patent: Aug. 2, 2005

(54) METHODS FOR DETECTING TRANSITIONS OF WAFER SURFACE PROPERTIES IN CHEMICAL MECHANICAL POLISHING FOR PROCESS STATUS AND CONTROL

(75) Inventors: Rodney Kistler, Los Gatos, CA (US); David J. Hemker, San Jose, CA (US); Yehiel Gotkis, Fremont, CA (US); Aleksander Owczarz, San Jose, CA (US); Bruno Morel, Santa Clara, CA (US); Damon V. Williams, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/966,744

(22) Filed: Oct. 14, 2004

(65) Prior Publication Data

US 2005/0054268 A1 Mar. 10, 2005

Related U.S. Application Data

(62) Division of application No. 10/113,151, filed on Mar. 28, 2002.

(51) Int. Cl.[7] ..... G06F 19/00
(52) U.S. Cl. ..... 700/121; 438/17
(58) Field of Search ..... 438/17; 700/121

(56) References Cited

U.S. PATENT DOCUMENTS

| | | | | |
|---|---|---|---|---|
| 3,874,123 | A | 4/1975 | Hopkins et al. | 51/120 |
| 4,197,676 | A | 4/1980 | Sauerland | 51/165 R |
| 4,556,845 | A | 12/1985 | Strope et al. | 324/230 |
| 4,600,469 | A | 7/1986 | Fusco et al. | 156/636 |
| 4,793,895 | A | 12/1988 | Kaanta et al. | 156/627 |
| 5,196,353 | A | 3/1993 | Sandhu et al. | 437/8 |
| 5,240,552 | A | 8/1993 | Yu et al. | 156/636 |
| 5,287,663 | A | 2/1994 | Pierce et al. | 51/401 |
| 5,308,438 | A | 5/1994 | Cote et al. | 156/636 |
| 5,337,015 | A | 8/1994 | Lustig et al. | 324/671 |
| 5,413,941 | A | 5/1995 | Koos et al. | 437/8 |
| 5,508,077 | A | 4/1996 | Chen et al. | 428/64.3 |
| 5,559,428 | A | 9/1996 | Li et al. | 324/71.5 |
| 5,597,442 | A | 1/1997 | Chen et al. | 156/626.1 |
| 5,643,050 | A | 7/1997 | Chen | 451/10 |
| 5,647,952 | A | 7/1997 | Chen | 156/636.1 |
| 5,731,697 | A | 3/1998 | Li et al. | 324/71.5 |
| 5,888,120 | A | 3/1999 | Doran | 451/41 |
| 5,889,401 | A | 3/1999 | Jourdain et al. | 324/230 |
| 5,916,015 | A | 6/1999 | Natalicio | 451/288 |
| 5,938,502 | A | 8/1999 | Kubo | 451/6 |
| 5,944,580 | A | 8/1999 | Kim et al. | 451/9 |
| 5,958,148 | A | 9/1999 | Holzapfel et al. | 134/18 |
| 5,969,521 | A | 10/1999 | Kurita et al. | 324/229 |
| 5,972,162 | A | 10/1999 | Cesna | 156/345 |
| 5,985,094 | A | 11/1999 | Mosca | 156/345 |
| 5,993,302 | A | 11/1999 | Chen et al. | 451/285 |
| 6,012,964 | A | 1/2000 | Arai et al. | 451/5 |
| 6,030,488 | A | 2/2000 | Izumi et al. | 156/345 |
| 6,056,632 | A | 5/2000 | Mitchel et al. | 451/288 |
| 6,072,313 | A | 6/2000 | Li et al. | 324/230 |
| 6,106,662 | A | 8/2000 | Bibby, Jr. et al. | 156/345 |
| 6,110,026 | A | 8/2000 | Arai | 451/289 |
| 6,146,242 | A | 11/2000 | Treur et al. | 451/6 |
| 6,224,461 | B1 | 5/2001 | Boehm, Jr. et al. | 451/7 |
| 6,375,540 | B1 | 4/2002 | Mikhaylich et al. | 451/6 |
| 6,402,589 | B1 | 6/2002 | Inaba et al. | 451/5 |

*Primary Examiner*—Albert W. Paladini
*Assistant Examiner*—Carlos Ortiz Rodriguez
(74) *Attorney, Agent, or Firm*—Martine Penilla & Gencarella, LLP

(57) ABSTRACT

In chemical mechanical polishing, a wafer carrier plate is provided with a cavity for reception of a sensor positioned very close to a wafer to be polished. Energy resulting from contact between a polishing pad and an exposed surface of the wafer is transmitted only a very short distance to the sensor and is sensed by the sensor, providing data as to the nature of properties of the exposed surface of the wafer, and of transitions of those properties. Correlation methods provide graphs relating sensed energy to the surface properties, and to the transitions. The correlation graphs provide process status data for process control.

17 Claims, 19 Drawing Sheets

METHODS FOR DETECTING TRANSITIONS OF WAFER SURFACE PROPERTIES IN CHEMICAL MECHANICAL POLISHING FOR PROCESS STATUS AND CONTROL

RELATED APPLICATION

The present application is a divisional of co-pending U.S. patent application Ser. No. 10/113,151, filed on Mar. 28, 2002, entitled "Apparatus and Methods for Detecting Transitions Of Wafer Surface Properties In Chemical Mechanical Polishing for Process Status and Control", by Yehiel Gotkis, David J. Hemker, Rodney Kistler, Bruno Morel, Aleksander Owczarz, and Damon V. Williams (the "Parent Application"), priority under 35 U.S.C. 120 is hereby claimed based on the Parent Application, and such Parent Application is hereby incorporated by reference.

BACKGROUND OF THE INVENTION

1. Field of the Invention

The present invention relates generally to semiconductor manufacturing and more specifically to methods for detecting transitions of wafer surface properties in chemical mechanical polishing for process status and control.

2. Description of the Related Art

During semiconductor manufacturing, integrated circuits are defined on semiconductor wafers by forming various patterned layers over one another. These patterned layers disposed one over the other define a topography of a surface of the wafer. The topography becomes irregular, i.e., non-uniform (or inhomogeneous), during manufacture. These irregularities present problems during subsequent processing operations, especially in operations for printing a photolithographic pattern having small geometries, for example. The cumulative effects of the irregularities of the topography can lead to device failure and poor yields if the surface topography is not smoothed.

Planarization is used for smoothing the irregularities. One type of planarization is known as chemical mechanical polishing (CMP). In general, CMP processes involve holding and rotating the wafer, and urging the rotating wafer against a polishing pad. An abrasive liquid media (slurry) is applied to the pad to assist in the polishing. A problem encountered during CMP operations is the determination of a "status" during the CMP process. The status may be that a desired flatness of the topography has been achieved, or that there is a desired thickness of material remaining on the surface of the wafer. Other examples of such status relate to the composition of the processed material, e.g., that certain materials have been removed from the wafer so that, for example, certain material in a desired pattern remains as part of an exposed surface of the wafer. Additionally, the status may be that another point of processing has been attained, for example, clearance of overburden material. Also, such status may be that there is a change in the resistance of the processed material.

Each such status relates to a property of the semiconductor wafer and the films on the wafer. The properties may include, for example, topographical, thickness, composition of materials, reflectivity, resistivity, and film quality.

Prior methods of making such status determinations include removing the semiconductor wafer from processing equipment to facilitate stand-alone inspection metrology. Also, as described below, in-situ methods have been provided, and use laser interferometry or broad band spectroreflectometry to monitor the properties of the wafer surface without removing the wafer from the equipment. Also as described below, vibration sensors have been mounted on a head that carries a wafer carrier plate, such that the sensor on the head is located remotely from the wafer.

In-situ methods, such as laser interferometry or spectroreflectometry, typically require an ability to observe the wafer surface through the polishing pad, normally through a specially inserted window. FIG. 1A schematically illustrates a prior in-situ apparatus for measuring a thickness property of a layer of a wafer 102. The wafer 102 is supported on a carrier 104 that is rotated. During CMP operations the wafer 102 is pressed against a pad 106 in the presence of a slurry to planarize a surface 107 of the wafer 102. The pad 106 is supported by a platen 108. A window 110 in the platen 108 and the pad 106 allow a beam from a laser 112 to view the surface 107 of the wafer 102. The pad 106 and the platen 108 may rotate around an axis as illustrated by arrow 114, and the carrier 104 rotates the wafer 102 around an axis as illustrated by arrow 116 as the pad 106 and the platen 108 rotate. European Patent Nos. EP 0,738,561 A1 and EP 0,824,995 A1 discuss in detail a laser interferometer and are hereby incorporated by reference.

A problem encountered with in-situ monitoring of CMP operations is that the environment in a gap 118 between the surface 107 of the wafer 102 and the window 110 contribute to spectral signal variations which typically have changing optical properties due to the dynamic environment and the abrasive nature of the CMP process and due to deposition of process by-products. Slurry and residue from the wafer 102 and the pad 106, as well as air bubbles from turbulence, also contribute to the optical variations caused by the environment of the gap 118. For example, at the initiation of the CMP process the gap 118 is filled with slurry having certain optical characteristics, and calibrations are performed based on such initial optical characteristics. However, as the wafer 102 is planarized the slurry contains increasing percentages of residue from the wafer 102 and the pad 106. Such residue changes the optical characteristics of the slurry in the gap 118, which in turn subjects the measurement of the thickness property to errors. The errors occur when an endpoint detector associated with the laser 112 is calibrated based on those initial optical characteristics of only the slurry or fluid in the gap 118, and when the optical characteristics change for reasons other than the thickness property. While the window 110 may be located at different heights within the pad 106, a gap 118 will always exist so that the window 110 does not come into contact with the wafer 102. U.S. Pat. No. 6,146,242 describes an optical endpoint window disposed under a window in the polishing pad and is hereby incorporated by reference.

Such in situ monitoring is also subject to other limitations. Typically, the location of the window 110 in the platen 108 only periodically overlaps the wafer 102 as the wafer 102 and the platen 108 rotate on the respective axes. As a result, the window 110 in the platen 108 acts as a shutter so that the laser 112 does not constantly illuminate the wafer 102. Also, the shutter action only allows a periodic response by optical devices that receive the laser light reflected from the wafer 102.

In view of these limitations of in-situ monitoring of CMP operations, attempts have been made to sense vibrations during CMP operations. However, referring to FIG. 1B, because typical vibration sensors 130 have been mounted on a head 132 remotely from an interface 134 between a wafer 136 and a pad 138, there is significant mechanical structure between the wafer-pad interface 134 and the sensor 130.

Such structure may include a wafer carrier plate 140 and a connector 142 that joins the carrier plate 140 to a rotary drive 144. The wafer carrier plate 140 and the connector 142 interfere with the transmission of vibrations (see arrow 146) from the interface 134. As a result, vibrations (see arrows 148) resulting from the physical characteristics of such structure are more strongly received by the sensor 130, as compared to the vibrations 146 based on the wafer properties at the wafer-pad interface 134 at which the remotely located CMP process takes place. Thus, the process vibrations 146 tend to be dampened as they travel to the remotely located sensor 130. Further, such vibrations 146 are weak in comparison to the vibrations 148 resulting from the physical characteristics of the structure, there tends to be a loss of resolution from the CMP process vibrations 146, and there may be a low signal-to-noise ratio with respect to the process vibrations 146. As a result, the remote sensor 130 tends to output signals that do not accurately indicate the wafer properties at the wafer-pad interface 134, hence the status of the CMP processing may not be accurately indicated. Therefore, control of the CMP process using such inaccurate output signals also tends to be inaccurate.

These limitations of the prior in-situ monitoring, and of the prior vibration sensing, for example, have caused problems in detection of status transitions, or transitions, which are important and characteristic changes in the surface properties of the wafer surface or of the films occurring in a pad/wafer interaction interface and at the wafer surface during CMP processing of the wafer.

What is needed then is a method for detecting the transitions in the wafer and film properties. Such need is to detect such transitions while avoiding the limitations of optical systems that view the wafer through the polishing pad. Therefore, there is a need in such polishing for inspection methods which constantly observe the properties of the polishing surface and/or of a parameter linked to the pad/wafer interface, for detecting any such occurring transitions. Further, there is a need for CMP process status and control methods in which the properties of the wafer surface are sensed at the closest proximity to the wafer, most preferrably within the wafer carrier plate rather than remotely as in the prior remote vibration sensors. A related need is to provide an improved way of sensing parameter variations that reflect the changes in the properties occurring in the wafer/pad interaction interface and/or at the wafer surface. Such improved way should avoid dampening the process-based vibrations before such vibrations are sensed, should result in strong reception of the process vibrations in comparison to vibrations based on the physical characteristics of the structure, should provide a gain in resolution, and should improve the signal-to-noise ratio with respect to the process vibrations. In addition, there is a need for increasing the amount of wafer area that is sensed, so as to sense changes in different properties at different areas of the wafer surface, as compared to the relatively small wafer surface areas sensed by most of conventional in-situ sensors, for example.

SUMMARY OF THE INVENTION

Broadly speaking, the present invention fills these needs by providing methods for detecting transitions, such as electrical, topographical and compositional transitions, of wafer properties at the surfaces of wafers or in the wafer/pad interaction interface in chemical mechanical polishing for CMP process status and control. Such methods avoid the limitations of conventional optical systems that view the wafer through the limited size window in the polishing pad, for example. Such methods also fill a need in such polishing for methods which constantly observe the properties of the polishing surface and/or of parameters linked to the pad/wafer interface, for detecting any such occurring transitions. Such methods also fill a need for CMP process status and control methods and in which the properties of the wafer surface are sensed at a location in closest proximity to the wafer, preferrably within the wafer carrier plate rather than remotely as in the prior remote vibration sensors.

The present invention also fills the need to provide an improved way of sensing vibrations that are generated as wafer surfaces having different properties are subjected to friction-based CMP material removal action. Such improved way avoids dampening the process-based vibrations before such vibrations are sensed, results in strong reception of the process vibrations in comparison to vibrations based on the physical characteristics of the structure, provides a gain in resolution, and improves the signal-to-noise ratio with respect to the process vibrations. Such improved way also allows optimization of the sensing range (as by the use of a most efficient frequency range, for example). In addition, the present invention fills the need for increasing the amount of wafer area that is sensed, as compared to relatively small wafer surface areas sensed by the conventional in-situ sensors, for example.

It should be appreciated that the present invention can be implemented in numerous ways, including as a method. Several inventive embodiments of the present invention are described below.

In one embodiment, a method of obtaining wafer film property-sensor response correlation data is provided. The data represents properties of a surface layer of one or more known correlation semiconductor wafers. The surface properties result from chemical mechanical polishing treatment performed on the surface layer. The method includes operations of identifying an area on the surface of one of the correlation wafers. The area encompasses an initial known surface property, such as thickness. Another method operation conducts a first chemical mechanical polishing operation on the initial surface property within the area. The first chemical mechanical polishing operation causes the initial surface property to emit a first energy output. A further method operation determines a first energy characteristic of the first energy output emitted during the first chemical mechanical polishing operation. The first energy characteristic is unique to the initial surface property during the first chemical mechanical processing operation, and may, for example, be a signal output by a sensor immediately adjacent to the emitting initial surface property. Such first energy characteristic, or signal, thus represents the initial surface property during the CMP processing of the initial surface property, and provides one item of wafer film property-sensor response correlation data. In another method operation, the conducting and determining operations are repeated with respect to another correlation wafer having an exposed surface with at least one known lower surface property within the identified area, such as a final thickness. These conducting and determining operations cause the known lower surface property to emit at least one next energy output and to determine at least one next energy characteristic that is unique to the at least one known lower surface property, which is the thickness of the known lower surface. The next energy characteristic is unique to the known lower surface property during the next chemical mechanical processing operation, and may, for example, be a next signal output by the sensor immediately adjacent to the emitting lower surface property. Such next energy characteristic, or signal, thus represents the next surface property during the next CMP processing of the lower surface property, and provides another item of wafer film property-sensor response correlation data.

In another embodiment, a method is provided for controlling chemical mechanical polishing operations performed on a production wafer that is to have the same properties as the correlation wafers that were used for obtaining the wafer film property-sensor response correlation data. Operations of the method include an operation of mounting the production wafer on a wafer carrier that exposes a front surface of the production wafer to a polishing pad at a wafer-pad interface. The front surface of the production wafer and the interface have at least one area under which a plurality of surface configurations are located. The surface configurations overlie each other and include at least an upper surface configuration initially nearest to the front surface of the production wafer that is exposed for the chemical mechanical polishing operations. The surface configurations also including a final surface configuration initially spaced furthest from the front surface and toward a backside of the production wafer. Each such configuration may have one of the above-described properties, for example, of the corresponding correlation wafer. In another operation, chemical mechanical polishing operations are performed on the area of the production wafer so that the polishing pad causes energy to be emitted from the area of the wafer-pad interface according to the property of the surface configuration at the interface. A set of data is provided, and may be in the form of the wafer film property-sensor response correlation data obtained according to the above-described method. Such correlation data may include, for example, first data. The first data may correspond to energy emitted during previous correlation chemical mechanical polishing operation performed on each respective one of the surface configurations within a corresponding area of the correlation wafers that are similar to the production wafer. The first data includes a data portion that may correspond to a final property of the final surface configuration of the correlation wafer. An operation monitors the energy emitted from the wafer-pad interface of the production wafer during the chemical mechanical polishing operations performed on each respective one of the surface configurations of the production wafer. The energy emitted is related to the property of the surface configuration at the interface. A next operation compares the energy emitted from the area of the wafer-pad interface of the production wafer during the currently performed chemical mechanical polishing operations to the data portion of the first data that corresponds to the property of the final surface configuration of the correlation wafer. In the example of the correlation wafer, the data portion represents the final thickness of the known lower surface, which is a final surface configuration. A last operation interrupts the currently performed chemical mechanical polishing operations once the comparing operation determines that the energy emitted from the area during the currently performed chemical mechanical polishing operation is substantially the same as the portion of the first data that corresponds to the property of the final surface configuration of the correlation wafer.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by reference to the following detailed description in conjunction with the accompanying drawings, in which like reference numerals designate like structural elements.

FIGS. 2B through 2E are cross-sectional views of various surface properties of the exposed surface of the wafer during four typical successive stages of chemical mechanical polishing, wherein:

FIG. 2B illustrates a topographical property of a non-uniform area of the exposed wafer surface;

FIG. 2C illustrates another topographical property of a flat uniform area of the exposed wafer surface, and a thickness property;

FIG. 2D illustrates a compositional property of a non-uniform area of the exposed wafer surface typified by different materials at the exposed surface; and FIG. 2E illustrates a transition of a compositional property upon clearance of a diffusion barrier from a dielectric layer;

DETAILED DESCRIPTION OF THE PREFERRED EMBODIMENTS

An invention is described for a method for detecting surface properties, and transitions at the surfaces of wafers, and in the wafer/pad interaction interface in chemical mechanical polishing for CMP process status and control. Details are described for methods which constantly observe the properties of the polishing surface and/or of parameters linked to the pad/wafer interface, for detecting any occurring transitions. CMP process status and control methods and apparatus are also described by which the properties of the wafer surface are sensed at a location in closest proximity to the wafer, preferrably within the wafer carrier plate rather than remotely as in prior remote vibration sensors. It will be obvious, however, to one skilled in the art, that the present invention may be practiced without some or all of these specific details. In other instances, well known process operations have not been described in detail in order not to obscure the present invention.

Figure 2A:
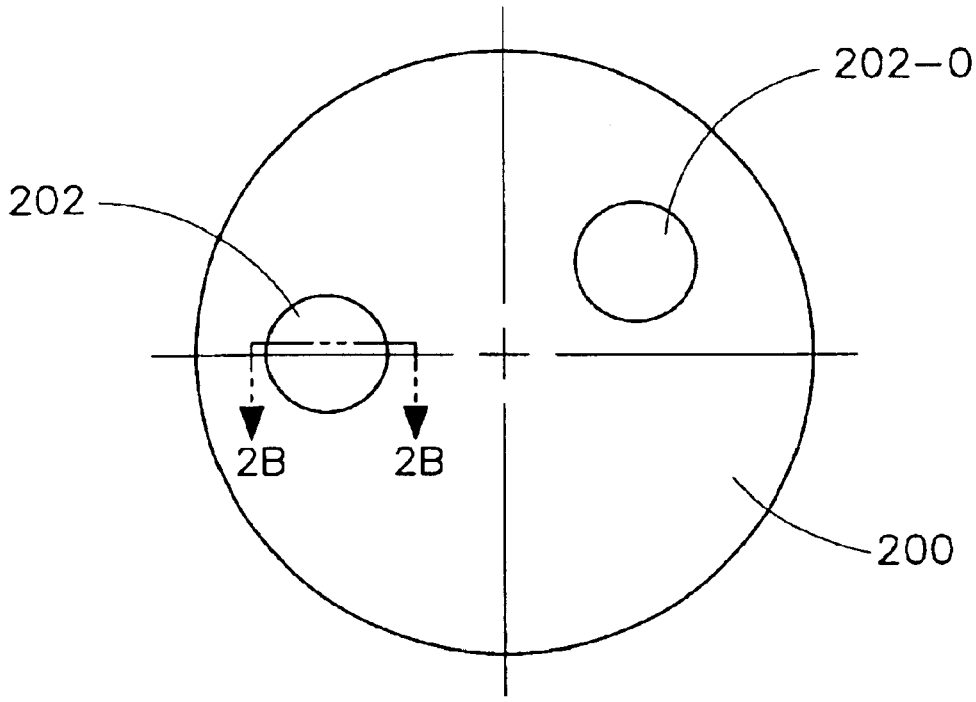
FIG. 2A is a plan view of a wafer illustrating areas on an exposed surface, wherein the areas may have unique surface properties to be sensed in accordance with the present invention.
Figure 2B:
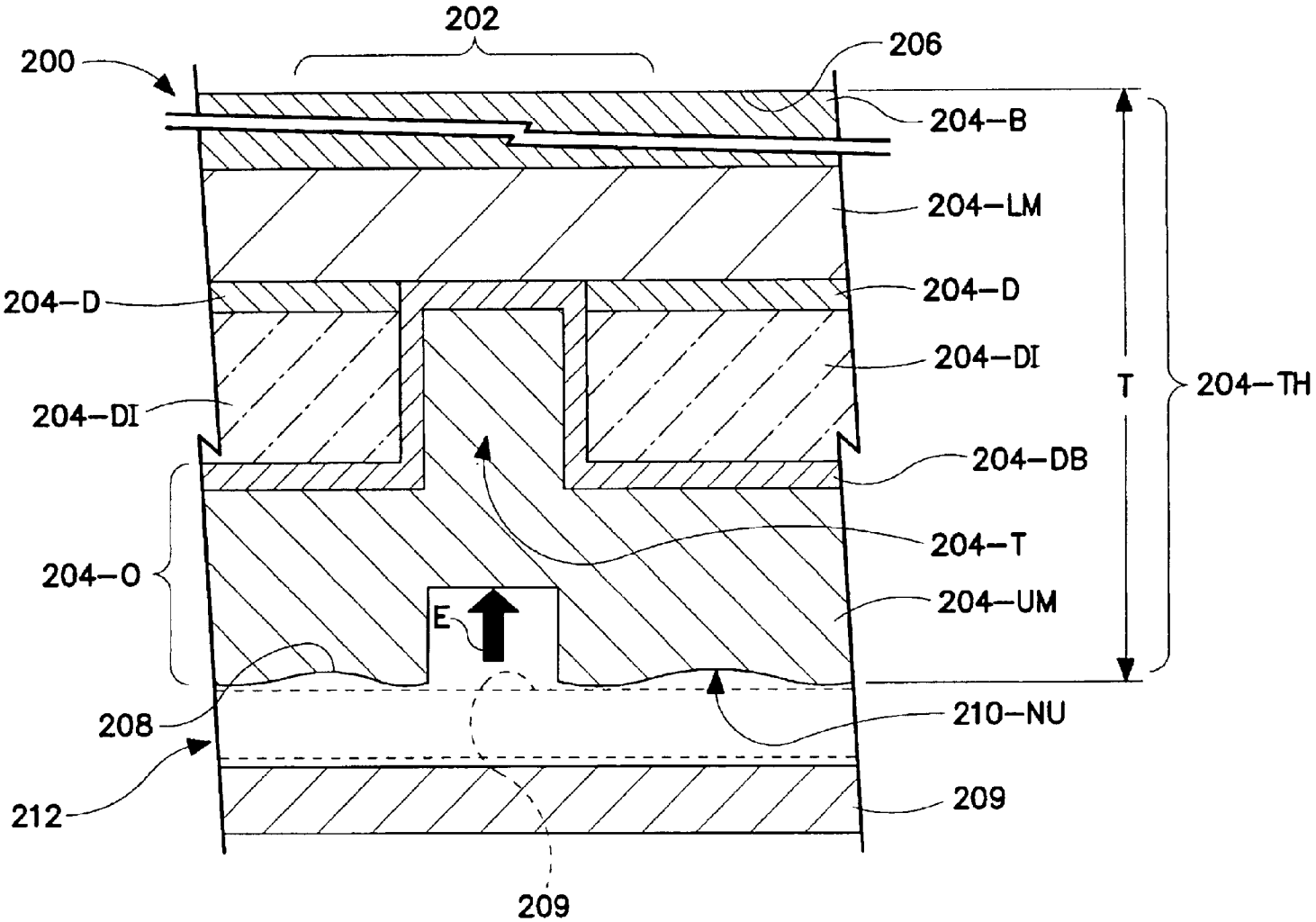

The non-uniform surfaces of the wafers may be understood by reference to FIGS. 2A through 2E. In FIG. 2A a semiconductor wafer 200 is shown in plan view as a disk, such as a disk having a 200 mm. or a 300 mm. diameter, for example. An area 202 is identified on the wafer 200 for purposes of description of the present invention. The area 202 defines the extent across the wafer 200 of a vertical series of exemplary layers 204 (FIGS. 2B through 2E). The cross-sections of FIGS. 2B through 2E are within and under the area 202. FIG. 2B shows various ones of the layers 204 before the wafer 200 is subjected to CMP processing, for example. Within and under the area 202, the layers 204 are between a backside 206 of the wafer 200 and a front, or exposed, surface 208 that is to be exposed to and in contact with a CMP polishing pad 209 for CMP processing. For clarity of illustration, the pad 209 and the exposed surface 208 are shown spaced.

Within and under the area 202, a backside, or support, layer 204-B supports a lower metallization layer 204-LM that is spaced from the front surface 208. Between the lower metallization layer 204-LM and the exposed surface 208, and within the area 202, a diffusion layer 204-D may be provided. A dielectric layer 204-DI may be deposited over the diffusion layer 204-D. A portion of the dielectric layer 204-DI is removed by etching, for example, to define a trench, or plug, 204-T. A two-part overburden layer 204-O (FIGS. 2B and 2C) may be provided over the dielectric layer 204-DI and in the trench 204-T. The overburden layer 204-O may include a thin diffusion barrier 204-DB (of Ta, TaN, TiN, or WN, for example) and an upper metallization layer 204-UM (of Cu, for example). The metallization layers 204-LM and 204-UM may be Cu, W, or Al, for example. The dielectric layer 204-DI may be silica (PETEOS), fluorinated silica, or low-K dielectric materials, such as those sold under the trade names CORAL or BLACK DIAMOND, for example.

The wafer 200 is shown in FIG. 2B with the described layers 204 in a condition prior to CMP processing. Within the area 202 the exposed surface 208 is formed by the upper metallization layer 204-UM which is part of the overburden layer 204-O. The upper metallization layer 204-UM is depicted having one type of surface property 210 of many types of surface properties of the exposed surface 208. As described above, the properties may include, for example, topographical (e.g., flatness), thickness, composition of materials, reflectivity, resistivity, and film quality. The type shown in FIG. 2B may be described as topographical, exemplified by a non-uniform, wavy or not flat, configuration of the exposed surface 208 within the area 202. Such topographical surface property (see 210-NU in FIG. 2B) is one of the surface properties 210 that may be detected and controlled by the present invention. Referring to FIG. 2A, it may be understood that numerous other areas 202-O may be identified on the exposed surface 208 of the wafer 200, and each such other area 202-O may define the extent of another vertical series of exemplary layers 204. Such other vertical series of exemplary layers 204 may have layers 204 differing from the layers 204 defined by the area 202, for example.

Figure 2C:
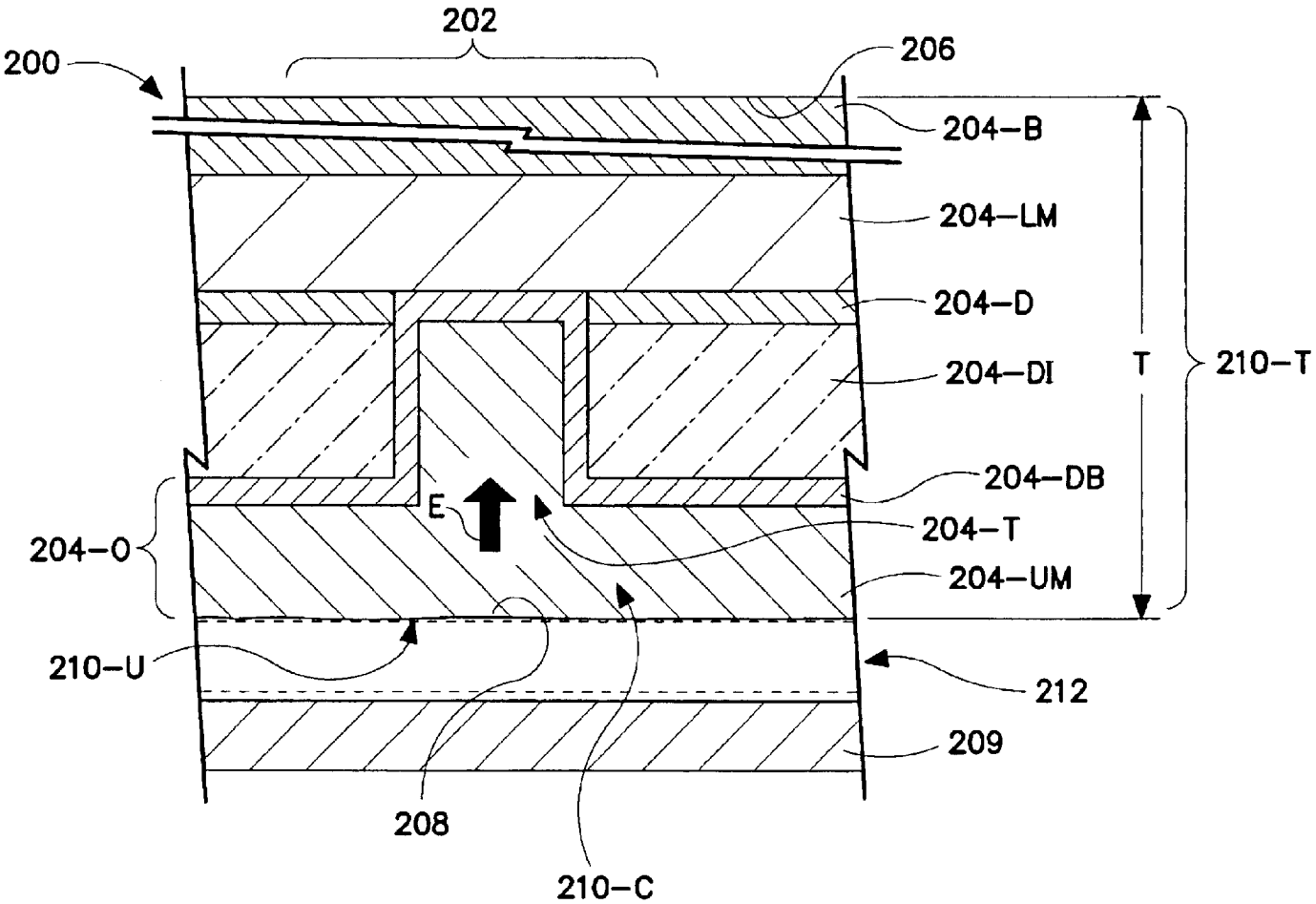

A typical object of the CMP processing is to render the exposed surface 208 smooth, or flat. Describing the CMP processing with respect to the area 202, for example, the exposed surface 208 (having the non-uniform topographical surface property 210-NU) may be rendered smooth, or flat, within the area 202, as shown in FIG. 2C to provide a uniform surface property 210-U. During the CMP processing, frictional contact is made between the pad 209 (contact is shown by upper dashed lines in FIGS. 2B, 2D and 2E, for example) and the exposed surface 208 at a wafer-pad interaction interface 212 that is within the area 202. According to the principles of the present invention, the frictional contact between the exposed surface 208 and the polishing pad 209 at the wafer-pad interface 212 varies according to the features of the surface property 210. Such variation occurs as to the portion of the entire wafer-pad interface 212 that is within the area 202. For example, the frictional contact may vary according to the type of transition (e.g., electrical, topographical or compositional) that occurs at the exposed surface 208 of the wafer 200, or in the wafer/pad interaction interface 212. The frictional contact results in energy E (see arrows E in the various Figures) being generated at the exposed surface 208 of the wafer 200. The energy E may be described as being transferred, emitted, or transmitted, for example, from the exposed surface 208 or the wafer-pad interaction interface 212, for example. Such terms transferred, emitted, or transmitted collectively refer to the exposed surface 208 (and the wafer-pad interface 212) as being a source of information, or data, or the energy E relating to the exposed surface 208. The amount (e.g., intensity) and type of the energy E from the exposed surface 208 and the wafer-pad interface 212 vary with the changes in the frictional contact within the area 202.

By the CMP processing, the surface property 210 of the exposed surface 208 within the area 202 may be changed, for example, from the non-uniform (e.g., wavy) type of property 210-NU to the uniform (e.g., flat) surface property 210-U shown in FIG. 2C. The nature of the frictional contact changes as the surface property 210 changes, such that the amount and type of the energy E from the exposed surface 208 and the wafer-pad interface 212 vary according to the type of surface property 210 that is being processed. Such change from non-uniform to uniform is one of the changes of a surface property 210 within the area 202 that may be detected and controlled by the present invention.

Figure 2D:
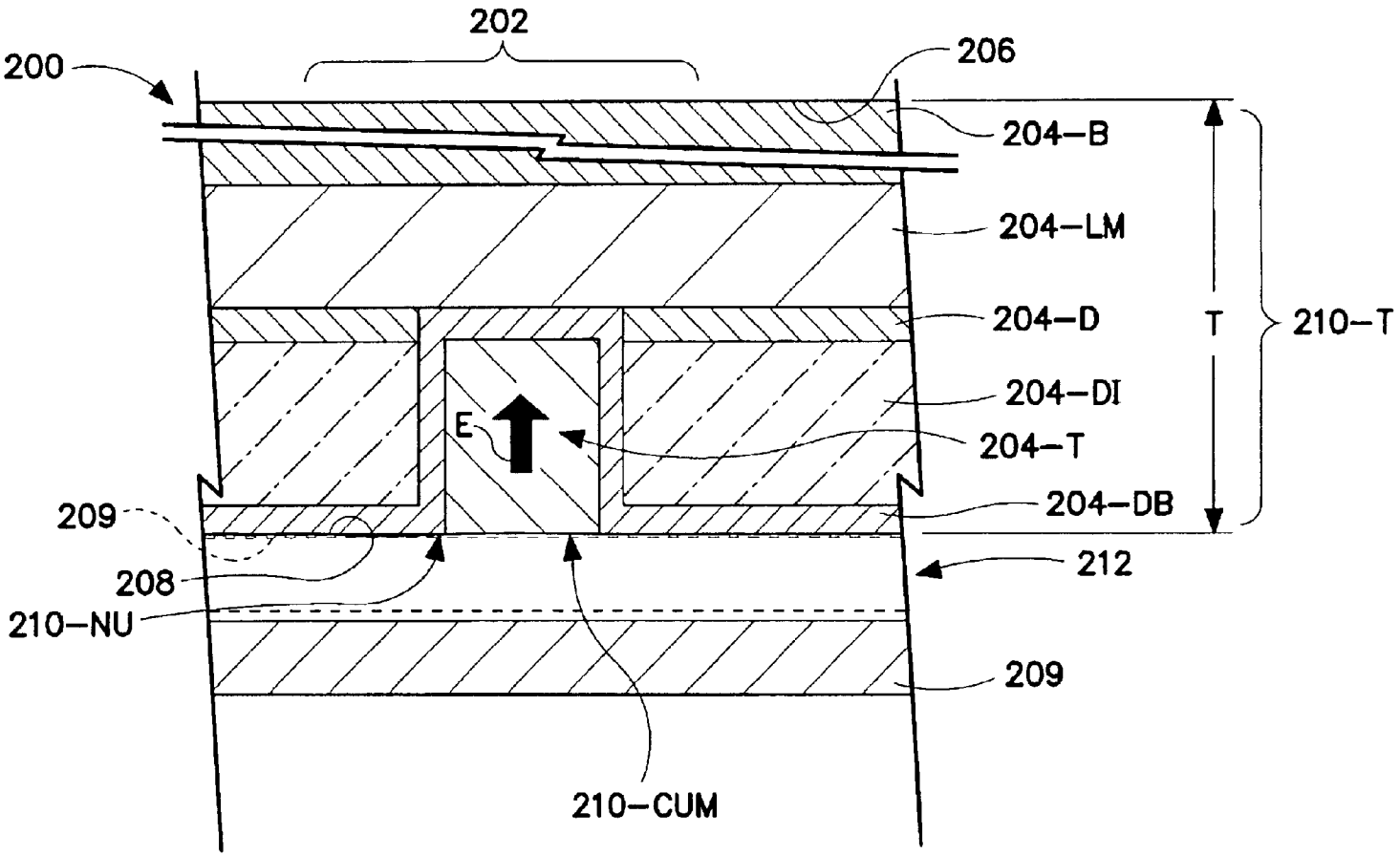

FIGS. 2C and 2D show another type of topographical transition, or change, of the surface property 210 of the exposed surface 208. Such change is the location of the exposed surface 208 from the backside 206. Such location changes as there are changes in the thickness T of the wafer 200, and corresponds to a surface property 210-T (see also exemplary properties 210-T1 and 210-T2 in respective FIGS. 3D and 3E). The value of the thickness T is greater in FIG. 2C than in FIG. 2D, for example. Such thickness T is a quantitative feature that may be measured by the present invention. Also, changes in the thickness T within the area 202 are one of the changes of the surface property 210-T that may be detected and controlled by the present invention.

FIGS. 2C and 2D also show that as CMP processing occurs, and as the thickness T changes, the upper metallization layer 204-UM portion of the overburden layer 204-O may be removed, or "cleared", and the diffusion barrier 204-DB and the Cu in the trench 204-T may become the exposed surface 208 (FIG. 2D). The surface property 210-CUM (FIG. 2D) may used to identify such upper metallization clearance, which occurs at a moment when the upper metallization layer 204-UM is removed and leaves the diffusion barrier 204-DB and the Cu in the trench 204-T forming the exposed surface 208.

Such removal of the upper metallization layer 204-UM to change the composition of the exposed surface 208 is an example of a transition that may be sensed by the present invention.

Sensing of transitions, in this example a compositional transition, is important. For example, in CMP processing different consumables and process parameters must be used to process the upper metallization layer 204-UM than those used to process the diffusion barrier 204-DB. Thus, during CMP processing, it is important to be able to detect the compositional transition, from the upper metallization layer 204-UM to the diffusion barrier 204-DB and the Cu in the trench 204-T. Such detection allows appropriate and immediate changes to be made to the CMP process to properly process the diffusion barrier 204-DB and the Cu in the trench 204-T. In a similar manner, sensing of other transitions allows other appropriate and immediate changes to be made to the CMP process.

Because of the compositional transition to the diffusion barrier 204-DB and the Cu in the trench 204-T, the exposed surface 208 is also non-uniform, and may be identified by reference to the surface property 210-NU. The non-uniformity of the surface property 210-NU may result from the different composition of the materials themselves (referred to as a surface property 210-C, FIG. 2C). The non-uniformity may also result from the pattern in which the dielectric layer 204-DI, the diffusion barrier 204-DB, and the metallization layer 204-UM, for example, are deposited on the wafer 200 (referred to as a surface property 210-P, FIG. 2E), for example. Thus, the amount and type of energy E emitted from the wafer-pad interface 212 within the area 202 may vary with the changes in the frictional contact resulting from the different exemplary materials (e.g., Cu in the trench 204-T, and silica of the dielectric layer 204-DI) themselves, and from the pattern in which those barriers 204-DB and layers 204 are deposited on the wafer 200.

Figure 2E:
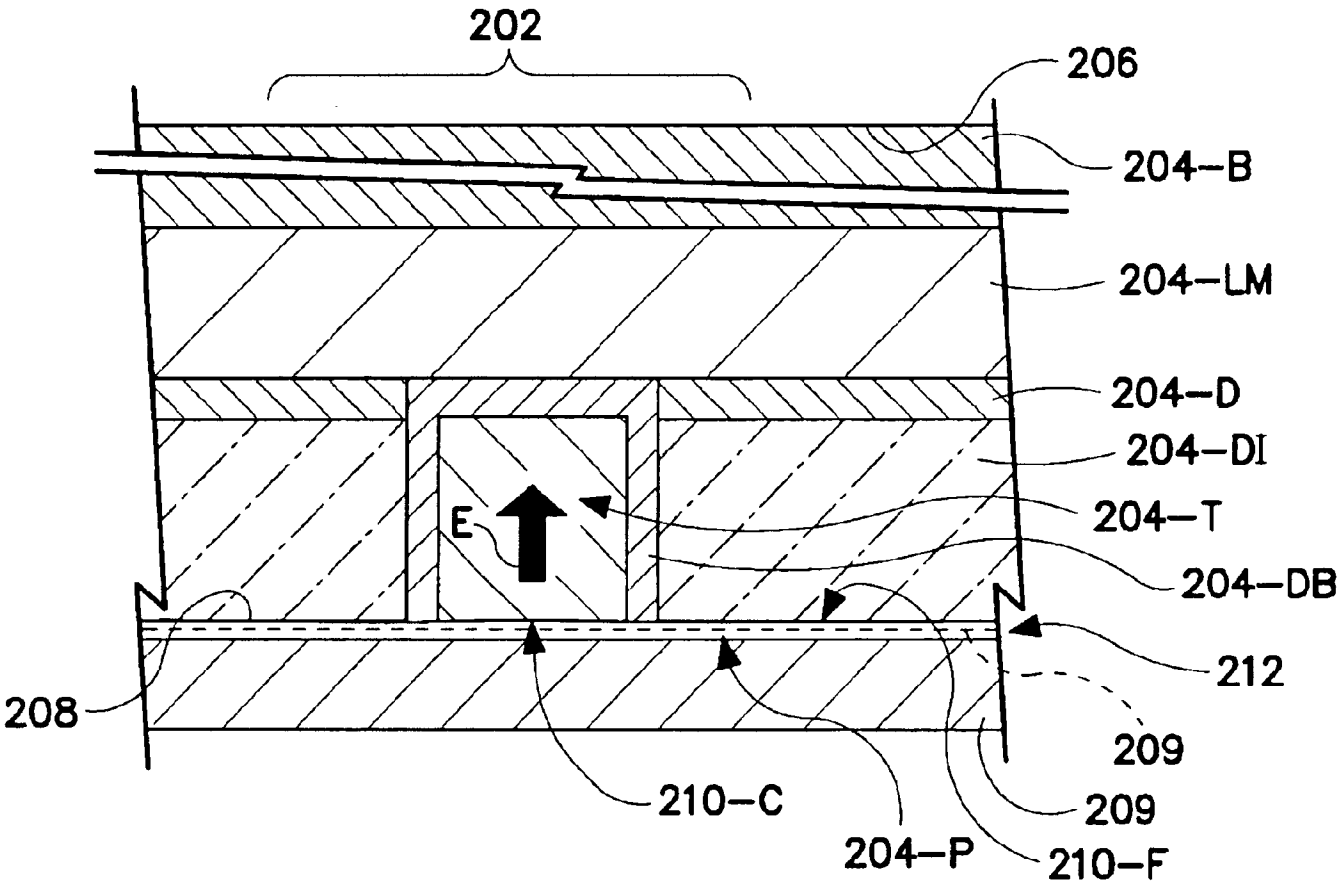

FIGS. 2C through 2E also show that as CMP processing occurs, and as the thickness T changes, there is an electrical transition as the upper metallization layer 204-UM portion of the overburden layer 204-O is cleared. Since the upper metallization layer 204-UM may be formed from Cu and is generally initially relatively thick, there is an ability to electromagnetically inductively couple with the upper metallization layer 204-UM. However, upon clearance of the upper metallization layer 204-UM and the diffusion barrier 204-DB, because the remaining dielectric layer 204-DI is non-conductive and the metallization (Cu, for example) in the trench 204-T has a small volume, this clearance results in a transition in the ability to electromagnetically inductively couple with metallization at the exposed surface 208. Thus, there is a significant decrease in such coupling ability when the entire upper metallization layer 204-UM has been removed so as to leave only the Cu in the trench 204-T and the lower metallization layer 204-LM for the electromagnetic inductive coupling.

Figure 3A:
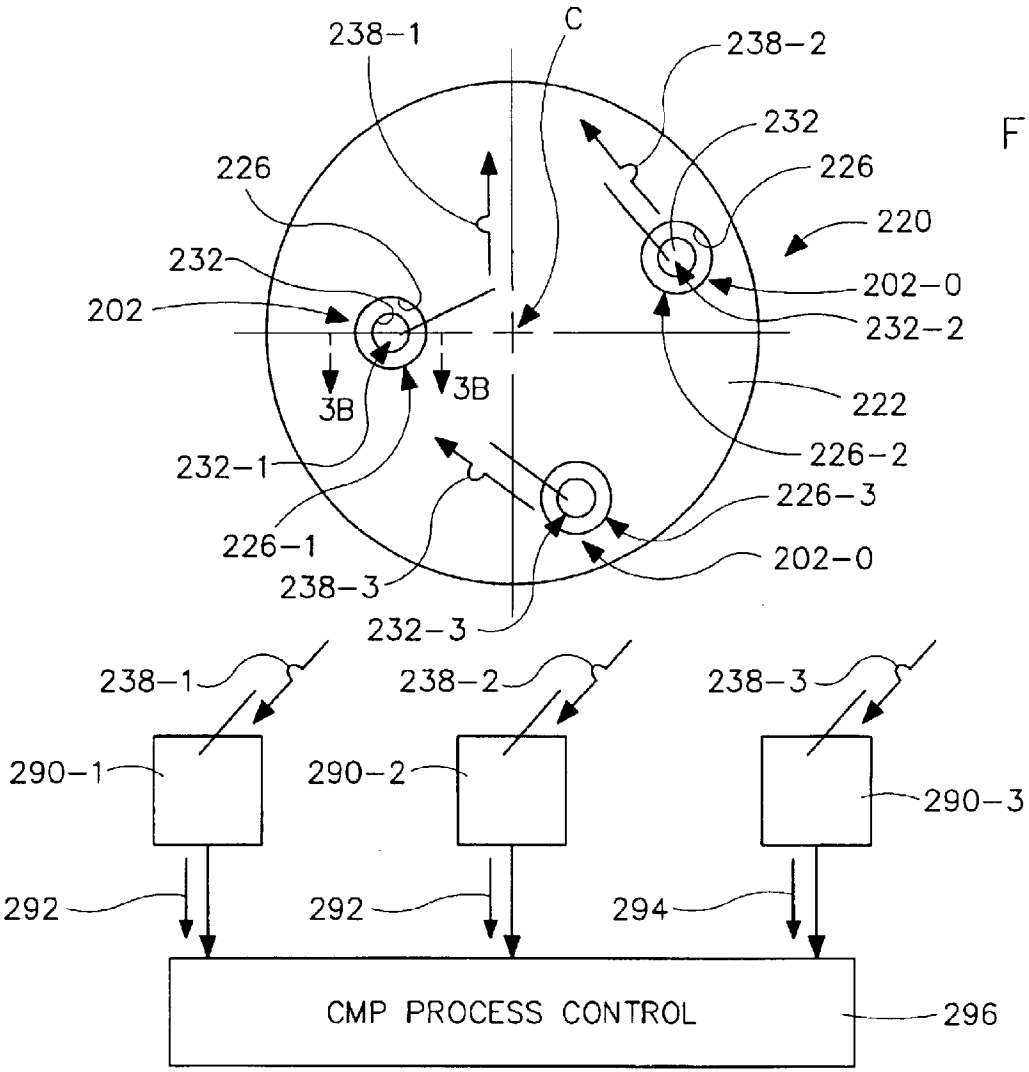
FIG. 3A is a plan view of a carrier plate having cavities for receiving and mounting respective sensors immediately next to a wafer mounting surface for sensing changes in properties of the exposed surface of the wafer in accordance with the present invention.
Figure 3B:
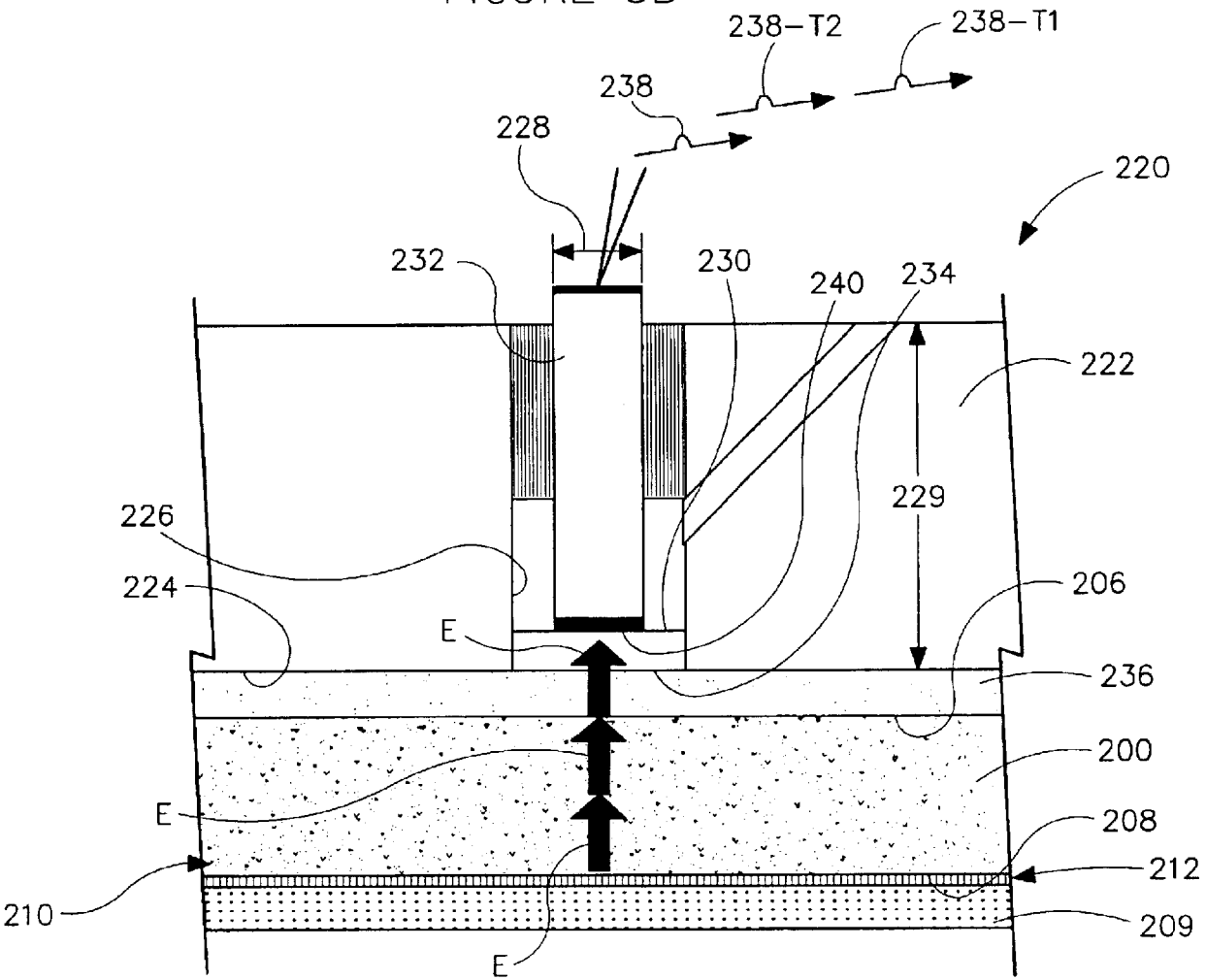
FIG. 3B is a cross-sectional view taken along lines 3B—3B in FIG. 3A, illustrating an active sensor in one of the cavities and the cavity opening directly to a continuous carrier (or backside) film on which a backside of the wafer is mounted in accordance with an embodiment of the present invention.
Figure 3C:
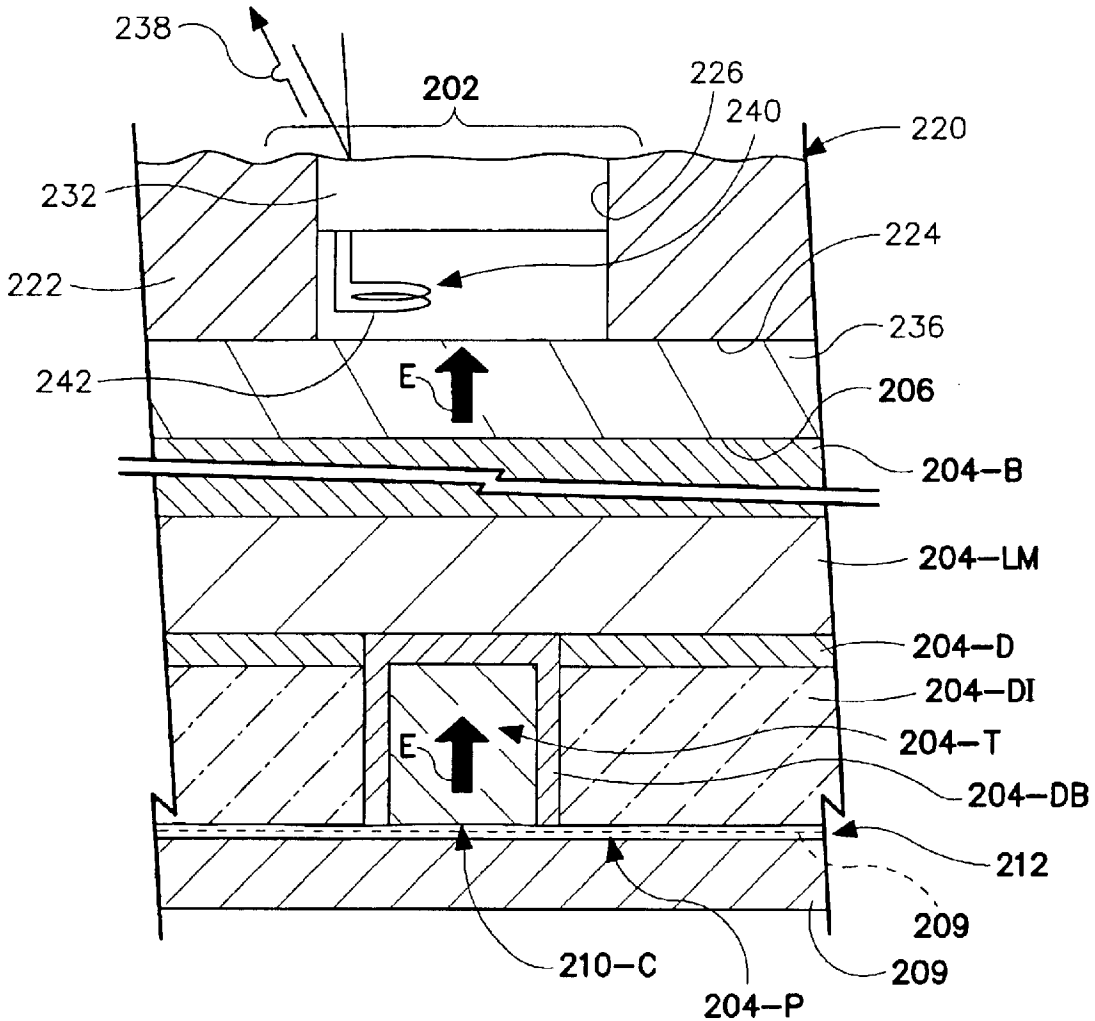
FIG. 3C is an enlarged view of the sensor shown in FIG. 3B, illustrating a coil positioned close to metallization on a front side of the wafer for response to electromagnetic inductive coupling with the metallization.

Referring also to FIGS. 3A through 3C, the embodiments of the present invention provide a system 220 for sensing the properties of the exposed surface 208 of the wafers 200, and for detecting transitions at and near the surfaces 208 of the wafers 200, or in the wafer/pad interaction interface 212 in chemical mechanical polishing for CMP process status and control. For example, such system 220 detects the properties 210 of the processed surface 208, such as of the exposed surface 208 of the wafer 200 shown in FIGS. 2A through 2E. The wafer 200 may be any of the above-described semiconductor wafers, for example, or similar substrates in which processing, such as CMP processing, is used for purposes such as planarization.

The plan view portion of FIG. 3A shows the system 220 including a wafer carrier or head, such as a wafer plate, 222 having a wafer mounting surface 224 (FIGS. 3B and 3C). The plate 222 may have structures (not shown) for supplying low pressure gas (vacuum) to the wafer mounting surface 224, for securing the wafer 200 to the plate 222, as more fully described in U.S. patent application Ser. No. 10/029,515, filed Dec. 21, 2001, for Chemical Mechanical Polishing Apparatus and Methods With Porous Vacuum Chuck and Perforated Carrier Film by inventors J. M. Boyd, M. A Saldana, and D. V. Williams, issued as U.S. Pat. No. 6,752,703; and in U.S. patent application Ser. No. 10/032,081, filed Dec. 21, 2001, for Wafer Carrier And Method For Providing Localized Planarization Of A Wafer During Chemical Mechanical Planarization by inventors Y. Gotkis, D. Wei, A. Owzarz, and D. V. Williams, which are incorporated by reference. Also, the plate 222 is provided with at least one aperture, or cavity, 226 extending into the plate 222 away from the wafer mounting surface 224.

FIG. 3A shows exemplary locations of the cavities 226 in which the cavities are positioned spaced from a center C of the plate 222. In FIG. 3B, the cavities 226 are shown configured with dimensions (e.g., diameter 228, or corresponding cross-sectional length and width dimensions, and a depth 229) suitable for reception of a sensor 232. Generally, the dimensions of each cavity 226 do not exceed a diameter of about 30 mm., for example. The exemplary positioning of each cavity 226 with respect to the center C, and the dimensioning of the cavity 226, are selected so as to align the cavity 226 with an exemplary respective one of the areas 202 of the wafer 200 with which the system 220 is to be used.

The sensor 232 may be inserted through an opening 234 of the cavity 226. The opening 234 is co-extensive with the wafer mounting surface 224. The opening 234 may be either mechanically open (as in a physical hole) or functionally open (as in a window that is transparent to an appropriate signal to be sensed). Also, a thin carrier, or backside, film 236 may be mounted on the wafer mounting surface 224, and may also be mechanically or functionally open according to the type of energy to be sensed. The backside film 236 may also have typical properties as described in the above-referenced patent applications filed on Dec. 21, 2001. The backside film 236 extends across the wafer mounting surface 224 for engaging the backside 206 of the wafer 200.

The configuring of the mechanical or functional opening of the carrier film 236 transmits all necessary types of the energy E from the wafer-pad interface 212 to the sensor 232. The types of transmitted energy E may include thermal, electromagnetic inductive coupling, and vibrational, for example. In the embodiment of the present invention shown in FIGS. 3B and 3C, the backside film 236 is physically continuous (i.e., without apertures), closes the cavity 226 and covers the sensor 232 received in the cavity 226.

The sensor 232 is configured to respond to the amount and type of energy E emitted from the portion of the wafer-pad interface 212, and from the corresponding exposed surface 208 of the wafer 200, that are associated with the exemplary one such area 202, as described above. In the embodiment of the carrier film 236 shown in FIGS. 3B and 3C, such energy E (e.g., emitted from the portion of the wafer-pad interface 212 associated with the exemplary area 202) is transmitted from the portion of the corresponding wafer-pad interface 212 through the wafer 200, and through the carrier film 236 into the cavity 226 to the sensor 232. The path of transmission of the energy E is short, in that the thickness of the wafer 200 is typically about 0.75 mm., the thickness of the carrier film 236 is about 0.5 mm., and a sensing end 240 of the sensor 232 is either co-extensive with the wafer mounting surface 224, or recessed and separated from the wafer backside 206 by a thin sealed spacer 230 that is co-extensive with the wafer mounting surface 224 for example. Moreover, the plate 222, the sensor 232, the film 236 and the wafer 200 move together as a unit, such that the sensor 232 in the cavity 226 always moves with the area 202 of the wafer 200. The sensor 232 is thus always in a position very close to the wafer-pad interface 212 to respond to the energy E transmitted from the portion of the wafer-pad interface 212 (and the exposed surface 208) that corresponds to the area 202.

Figure 3D:
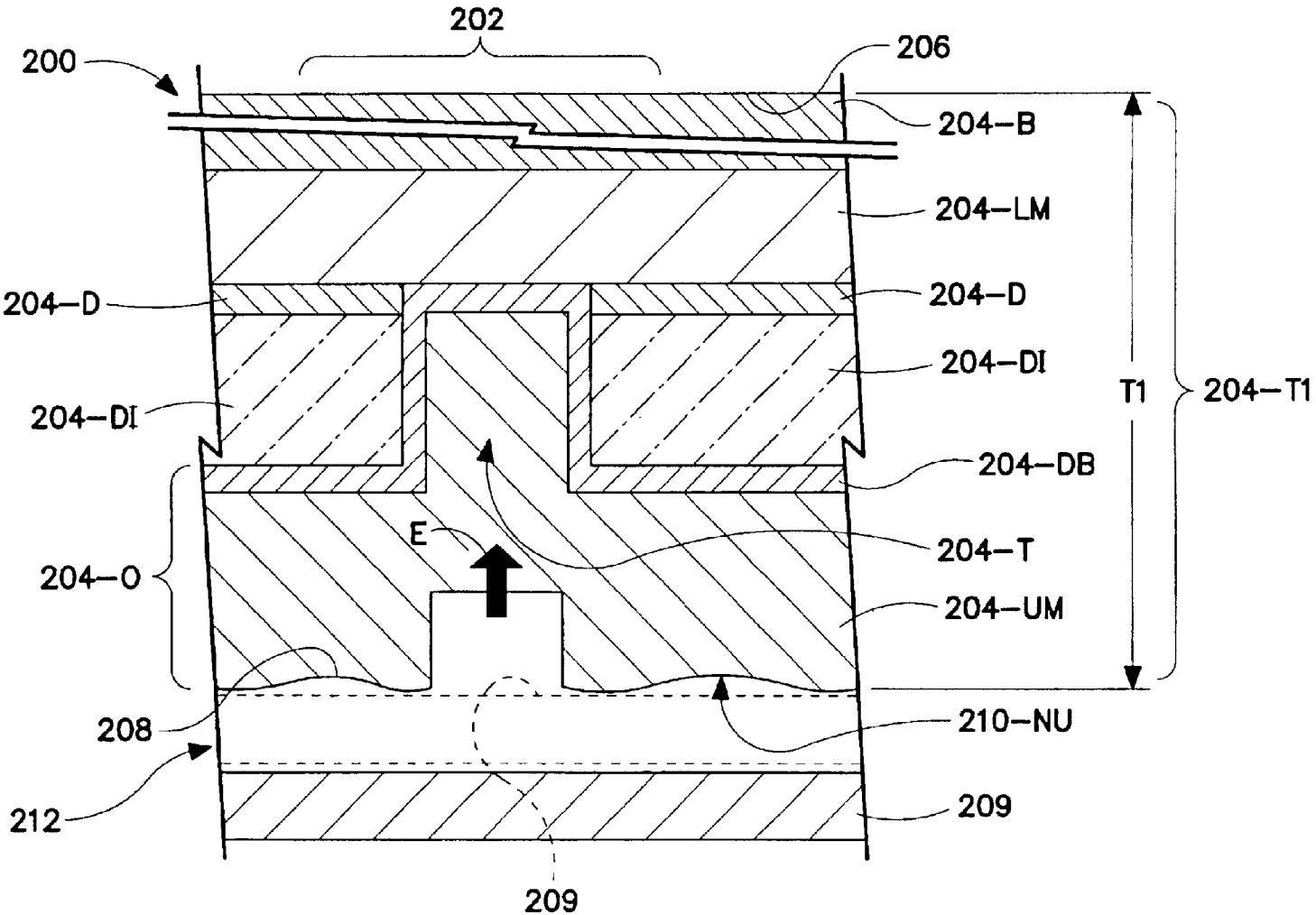
FIGS. 3D and 3E are further enlarged views of a portion of FIG. 3B, illustrating various thicknesses of wafer material between the backside and the exposed surface of the wafer.
Figure 3E:
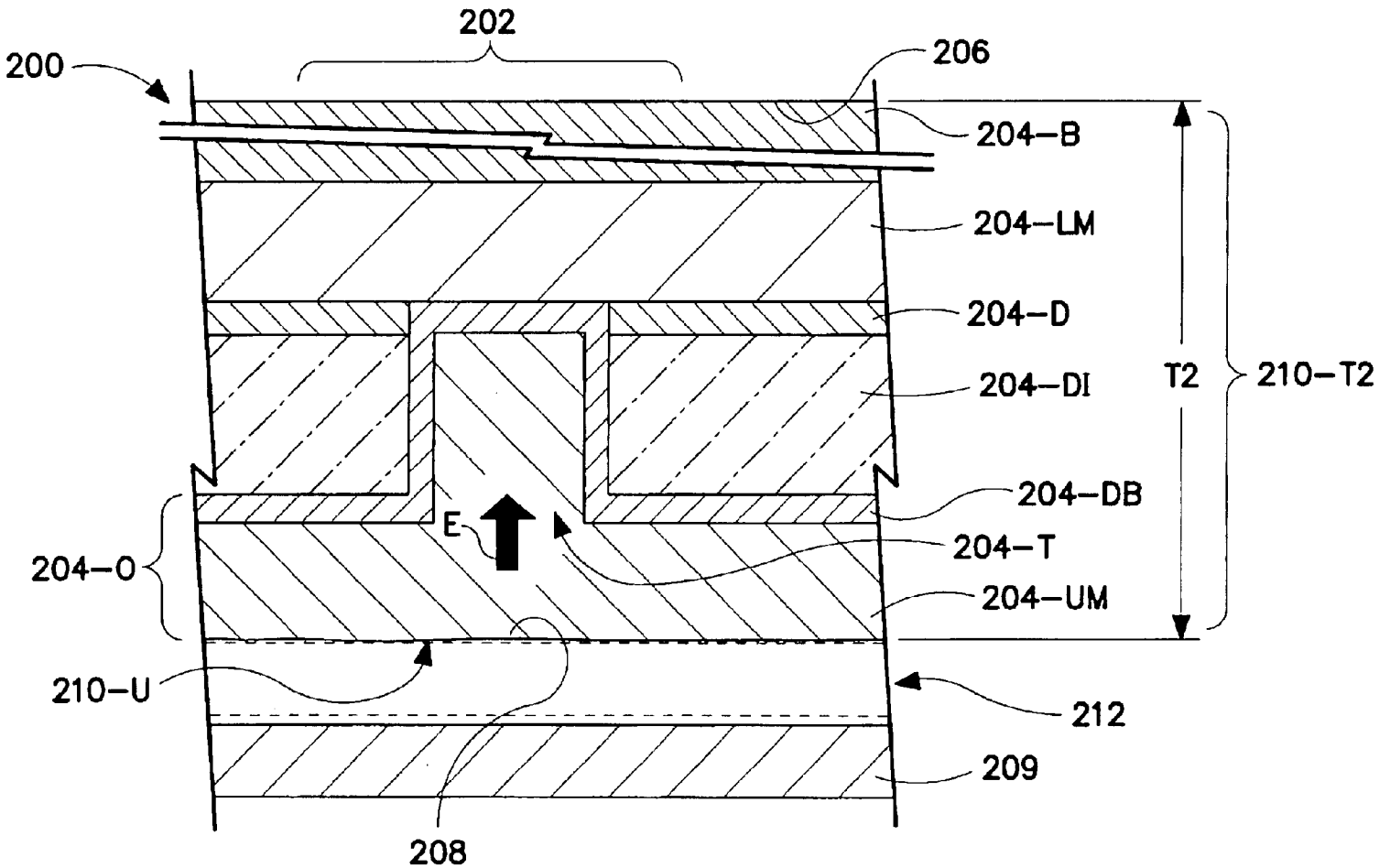

The sensor 232 responds to such energy E transmitted into the cavity 226 and generates an output signal 238 (FIG. 3B) that may be wirelessly transmitted to a suitable receiver described below. In a general sense, the output signals 238 may be understood in relation to the wafer surface properties 210 of an exemplary one of the areas 202 with which the cavity 226, and thus the sensor 232 in the cavity 226, is aligned. For example, referring to only the wafer 200, FIG. 3D shows a first wafer surface property 210-T1 based on a first thickness T1 of the wafer 200. FIG. 3E shows a second wafer surface property 210-T2 based on a second thickness T2 of the wafer 200. The energy E emitted from the exposed wafer surface 208 (i.e., from the portion of the wafer-pad interface 212 within the area 202) may have a first value that is unique to the first wafer surface property 210-T1 and may have a second value that is unique to the second wafer surface property 210-T2. The sensor 232 is configured to respond to the energy E having the first value for generating a first of the output signals 238, such as 238-T1 shown in FIG. 3B, indicative of the first property 210-T1, and to respond to the energy E having the second value for generating a second of the output signals 238, such as 238-T2, indicative of the second property 210-T2.

Referring to FIG. 3C, one embodiment of the system 220 is shown including the sensor 232 as an active sensor, which is in the form of an eddy current sensor configured with a sensor coil 242. The coil 242 is at the sensor end 240 and is thus at or very closely adjacent to the wafer mounting surface 224, such as spaced by 2 mm., for example. The coil 242 is thus essentially spaced from the backside 206 of the wafer 200 by only the small thickness of the carrier film 236. The coil 242 is in position for electromagnetic inductive coupling with the upper metallization layer 204-UM and with the Cu in the trench 204-T (FIG. 3D). The value of the electromagnetic inductive coupling, and the resulting induced eddy current in the coil 242, depend on the thickness of such upper metallization layer 204-UM and Cu in the trench 204-T. The sensor 232 outputs the output signal 238 (FIG. 3B) as a voltage signal having a value that indicates (via the correlation described below) the various thicknesses T, such as the thickness T1 and T2 (FIGS. 3D and 3E). The sensor 232 may also indicate another transition during the CMP processing. For example, by relating the thickness T to a known compositional property during the CMP processing, such as a change in the composition of the exposed surface 208 upon the complete removal, or clearance, of some of or the entire overburden layer 204-O from the dielectric layer 204-DI, a compositional, or clearance, transition may be identified. Thus, when the sensor 232 outputs the output signal 238 having a particular voltage value, through such correlation the clearance transition may be indicated. For electrical transition sensing purposes, the sensor 232 may be a product produced by Balluf, a Swiss company, or by Karman of the U.S.A., or by Micro-Epsilon of Germany.

The value of the output signal 238 of such sensor 232 is dependent in part on the structure of the carrier plate 222 and on other closely adjacent structures, such as the carrier film 236 and configurations of a polishing table (not shown) and of the pad 209. However, with the sensor 232 mounted in the plate 222 and very close to the backside 206 of the wafer 200, as described, the upper metallization layer 204-UM and the diffusion barrier 204-DB, for example, typically have respective thicknesses (e.g., in FIG. 3D) that are enough to enable the electromagnetic inductive coupling to the coil 242 to detect the thickness T within five percent, which is acceptable for use in the CMP processing. Such thicknesses are, for example, from about 2000 nm. to about zero nm. of a Cu layer 204-UM, and from about 100 nm. to about zero nm. of a TaN diffusion barrier 204-DB.

Also, with respect to sensing the surface property 210-C of the cleared exposed surface 208 described above (FIG. 2E), there may be up to fifty-percent, for example, of Cu in the pattern features that comprise the exposed surface 208 shown in FIG. 2E. However, it has been found that even with such percent Cu, the eddy current sensor 232 will sense the event of the clearance of the overburden layer 204-O from the dielectric layer 204-DI and the Cu in the trench 204-T. Since the eddy current sensor 232 uses active electromagnetic inductive coupling, this embodiment of the sensor 232 is referred to as an active sensor.

Figure 4A:
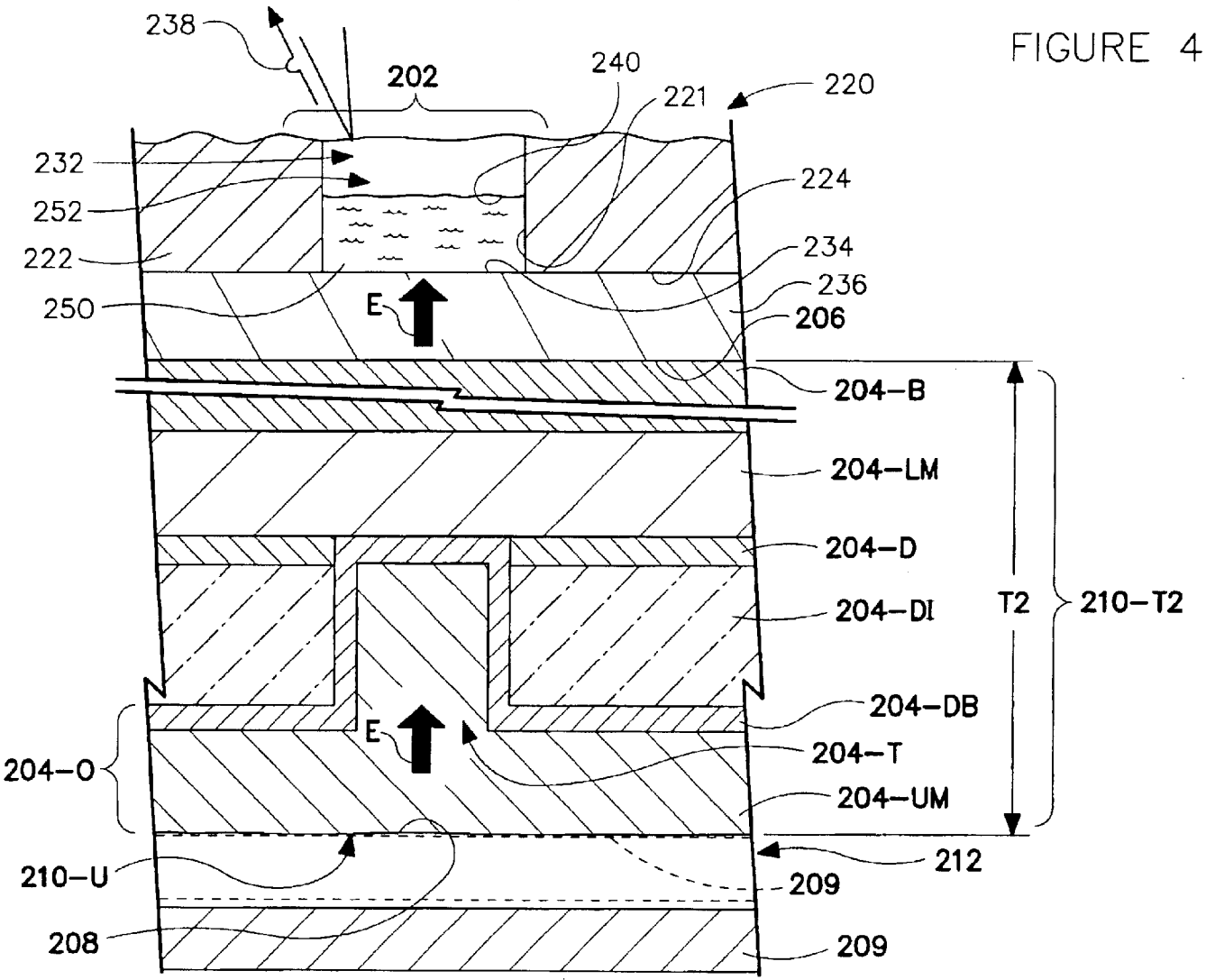
FIG. 4A is a cross-sectional view similar to FIG. 3C, illustrating a vibration-responsive passive sensor in the cavity and the cavity opening directly to a continuous backside film on which the backside of the wafer is mounted in accordance with another embodiment of the present invention.
Figure 4B:
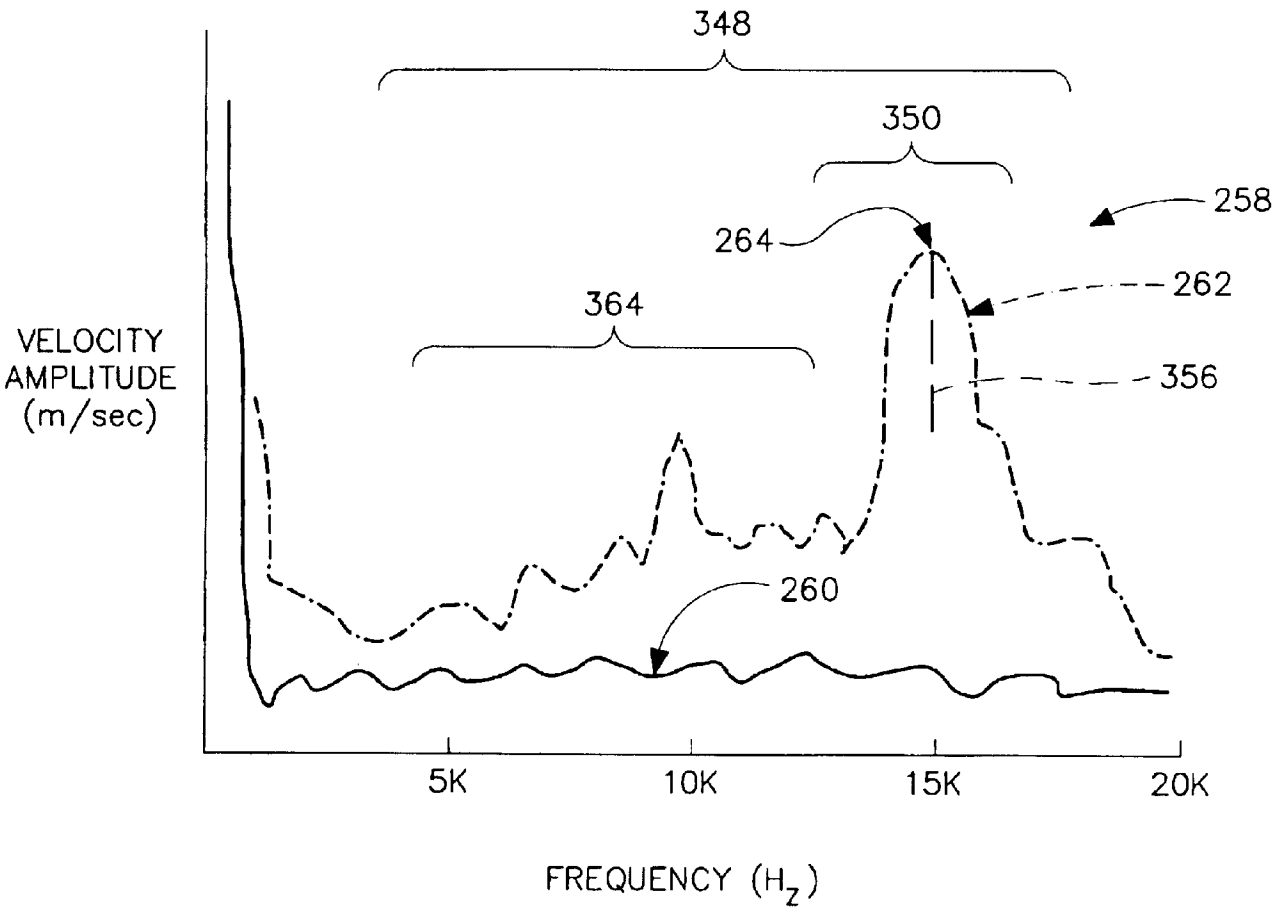
FIG. 4B is a wafer film property-sensor response correlation graph illustrating velocity amplitude plotted against frequency of vibrations sensed by the sensor of FIG. 4A during a CMP process performed on the exposed surfaces shown in FIGS. 2D and 2E, illustrating a peak amplitude at a particular frequency range, indicating a transition of a compositional property at the wafer front side as a result of front side layer CMP processing.

Referring to FIG. 4A, another embodiment of the system 220 is shown including the sensor 232 in the form of a vibration sensor configured with coupling fluid 250. The coupling fluid 250 may be deionized water (DIW) received in the cavity 226 between the opening 234 and a body 252 of the sensor 232. The fluid 250 is thus at the sensor end 240 and is thus at or closely adjacent to the wafer mounting surface 224. The fluid 252 couples vibrations to the sensor end 240 of the sensor 232, and is spaced from the backside 206 of the wafer 200 by the small thickness of the carrier film 236. The fluid 250 and the sensor 232 are in position to vibrationally couple with vibrations of the wafer 200 generated by the contact between the pad 209 and the exposed surface 208 of the wafer 200 during the CMP processing. These generated vibrations include an amplitude aspect and a frequency aspect. Such aspects are related to the surface property 210 that is being contacted by the pad 209 at the moment of time at which the particular vibration is generated. For example, the graph 258 shown in FIG. 4B plots amplitude vs. the frequency of such vibrations. In the graph 258, the amplitude is the amount of the velocity of the exposed surface 208. However, the amplitude of the displacement of the surface 208 may also be plotted, as well as the acceleration of such surface 208.

Considering the velocity amplitude of the graph 258, a curve 260 (solid line) illustrates low velocity amplitude vibrations in a vibration frequency range from about three thousand Hz to about twenty thousand Hz. Such low amplitude vibrations in that range are sensed by the vibration sensor 232 during CMP processing of the upper metallization layer 204-UM, for example, having the surface property 210-U (FIG. 2C). Significantly, even though the diffusion barrier 204-DB is underneath the upper metallization layer 204-UM, the vibrations generated during CMP processing of the upper metallization layer 204-UM are based on the upper metallization layer 204-UM and not on the underlying diffusion barrier 204-DB. Also, concerning the clearance transition to the diffusion barrier 204-DB as the exposed surface 208, FIG. 4B also shows a curve 262 (see dash-dash lines) illustrating relatively low amplitude vibrations in a vibration frequency range from about three thousand Hz to about twelve thousand Hz, and a unique high amplitude at a peak 264 in a vibration range of from about thirteen thousand Hz to about seventeen thousand Hz. The value of the peak 264 is significantly more than that of curve 260 in the thirteen to seventeen Hz range. Such peak vibration frequencies shown by the graph 262 are sensed by the vibration sensor 232 during CMP processing immediately after clearance of the upper metallization layer 204-UM, i.e., at the moment of contact between the pad 209 and the diffusion barrier 204-DB having the surface property 210 based on the composition of the diffusion barrier 204-DB. The important and characteristic change in the property 210 of the exposed wafer surface 208 is the change from the composition property 210-C, shown in FIG. 2C as a uniform property 210-U. The change is to the compositional non-uniform property 210-NU shown in FIG. 2D after the clearance of the upper metallization layer 204-UM. Such clearance is indicated in FIG. 2E by the property 210-CUM. Thus both compositional and clearance transitions occur at the moment of contact between the pad 209 and the diffusion barrier 204-DB in this example.

Returning again to FIG. 4A, the vibration sensor 232 generates the output signal 238 as a voltage signal having a value based on the amplitude and frequency of vibration generated at the wafer-pad interface 212 (e.g., of the surface 208), as described above. The vibration sensed by the sensor 232 may thus indicate, or detect, the compositional transition, from the upper metallization layer 204-UM to the diffusion barrier 204-DB and Cu in the trench 204-T, so that appropriate and immediate changes can be made to the CMP process to properly process the diffusion barrier 204-DB and the Cu in the trench 204-T. For example, correlation described below may relate the amplitude and frequency sensed by the sensor 232 to a known state during the CMP processing. Such state may be the compositional transition, which may be identified by the peak 264 at the described frequency range. Thus, when the sensor 232 outputs the output signal 238 having a peak voltage value corresponding to such frequency of the peak 264, by use of such correlation the compositional transition may be indicated.

Figure 1A:
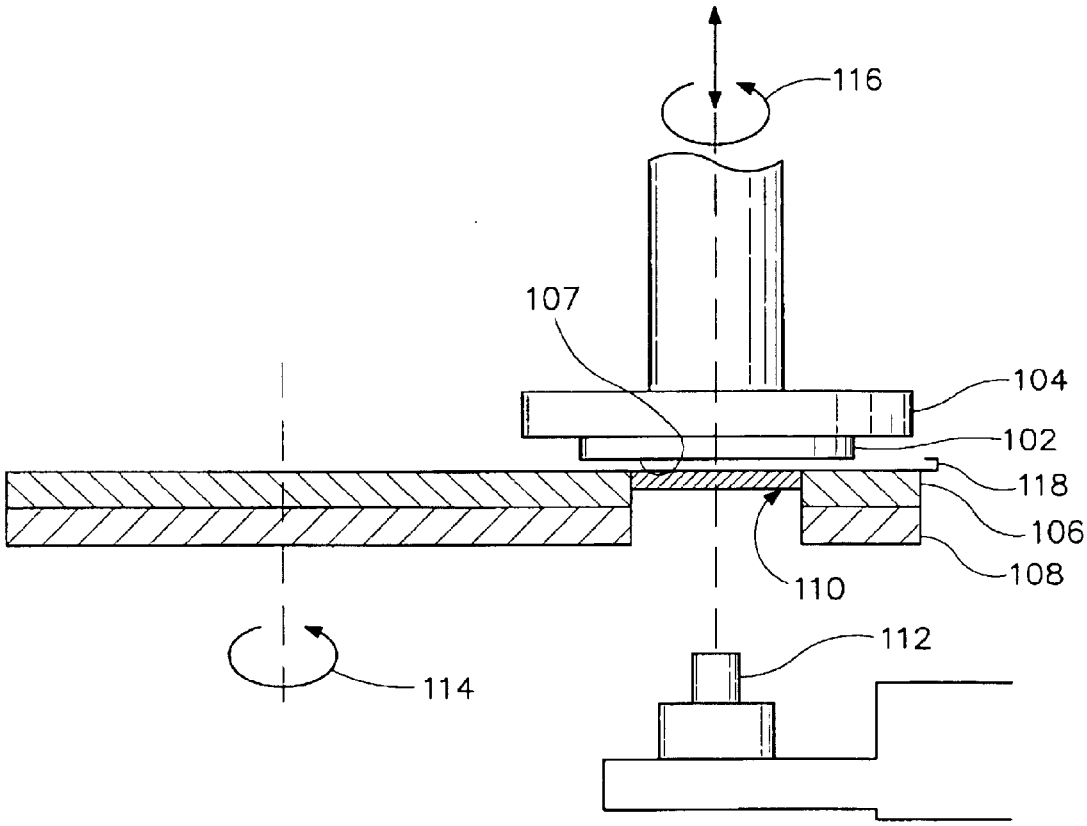
FIGURE 1A (PRIOR ART)
FIG. 1A is a schematic diagram of a prior art in-situ apparatus for measuring a thickness of a layer of a wafer by providing apertures in a platen and a polishing pad below the wafer.
Figure 1B:
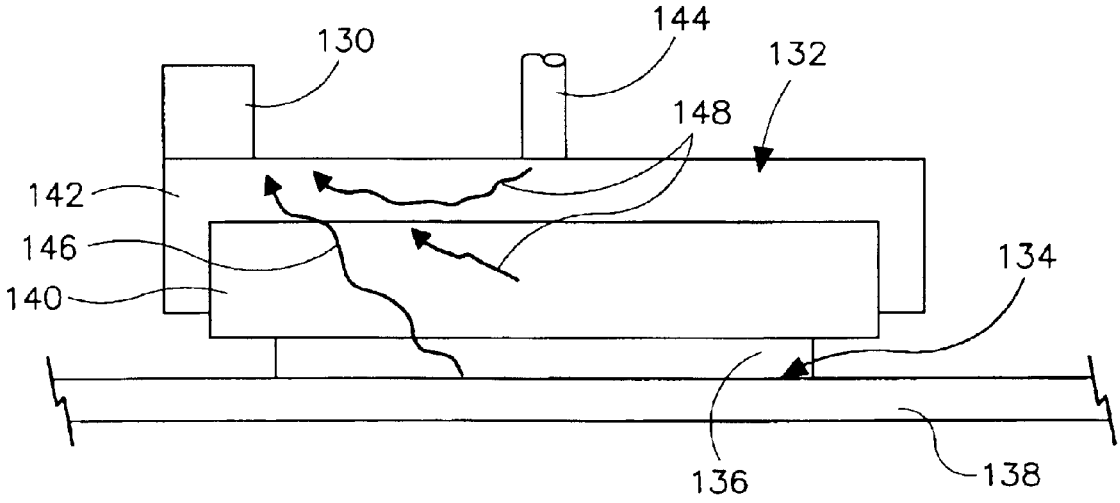
FIG. 1B is a schematic diagram of a prior art apparatus for detecting vibrations at a coupler that mounts a wafer carrier head to a CMP apparatus, wherein the apparatus is remote from a location of a wafer carried on a carrier plate secured to the wafer carrier head.

For vibration sensing purposes, the sensor 232 may be an active sensor 232 in that a sonic signal may be output by the active sensor 232 to the wafer-pad interface 212. The output sonic signal may be changed according to sonic waves generates at the wafer-pad interface 212 based on the nature of the frictional contact between the exposed surface 208 and the polishing pad 209. As described above, such frictional contact varies according to the features of the surface property 210. The output sonic signal from the sensor 232 that has been so changed returns to the sensor 232, and the output signal 238 is generated. The signal 238 of such sensor 232 is dependent in part on the structure of the carrier plate 222 and on other closely adjacent structures, such as the carrier film 236, the wafer 200, and on the various layers 204 that are present during the CMP processing. However, with the sensor 232 mounted in the plate 222 and coupled to the carrier film 236 as described, because such mounting places the sensor 232 with the coupling fluid 250 very close to (e.g., within millimeters of) the exposed surface 208 of the wafer 200 (as compared to the prior sensor 130 which is remotely located at the connector 142), vibrations caused by the other closely adjacent structures are minimized and there is relatively little dampening of the CMP process-induced vibrations, or of the returned sonic signal, before the process-induced change of the output sonic signal is sensed by the sensor 232. The signal to noise ratio of the output signal 238 is thus high relative to that from the prior remote sensor 130 (FIG. 1B).

Figure 5A:
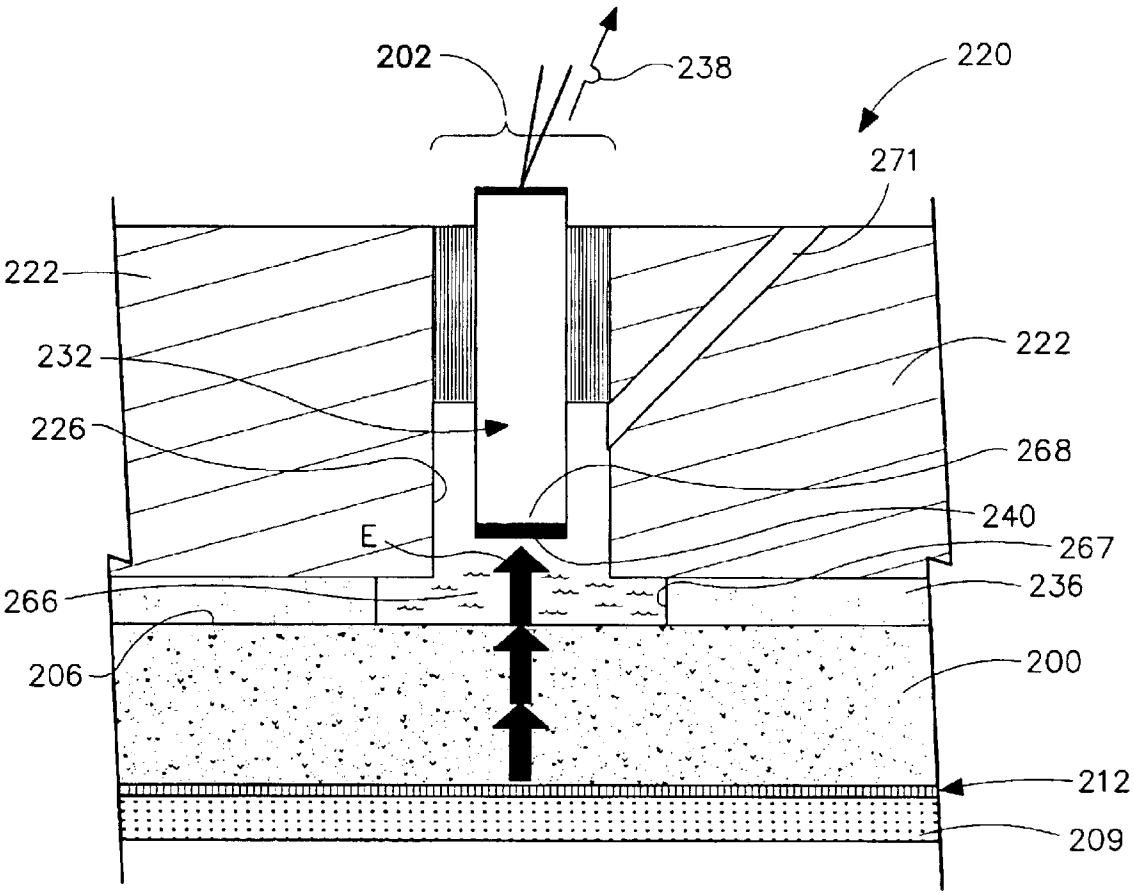
FIG. 5A is a cross-sectional view similar to FIG. 3B, illustrating a temperature-responsive passive sensor in the cavity and the cavity opening directly to an aperture in a backside film on which the backside of the wafer is mounted in accordance with another embodiment of the present invention.

Referring to FIG. 5A, another embodiment of the system 220 is shown including the sensor 232 in the form of a temperature sensor configured with thermal energy coupling fluid 266 supplied through a port 271. The coupling fluid 266 may be deionized water (DIW) received in both the cavity 226 and an aperture 267 provided in the carrier film 236 opposite to the cavity 226. The aperture 267 provides the above-described mechanical opening. The fluid 266 is thus in contact with, and in heat transfer relationship with, the backside 206 of the wafer 200. The fluid 266 in the aperture 267 and in the cavity 226 circulates from the backside 206 of the wafer 200 through the aperture 267 and in the cavity 226 to a body 268 of the sensor 232. The fluid 270 thus transfers to the sensor 232 the energy E received from the CMP operations at the interface 212. A time delay in which the fluid 266 reaches ninety-five percent of the temperature that will ultimately be reached is in the range of about 0.6 to about 0.8 seconds, which is acceptable for control of CMP processing.

Figure 5B:
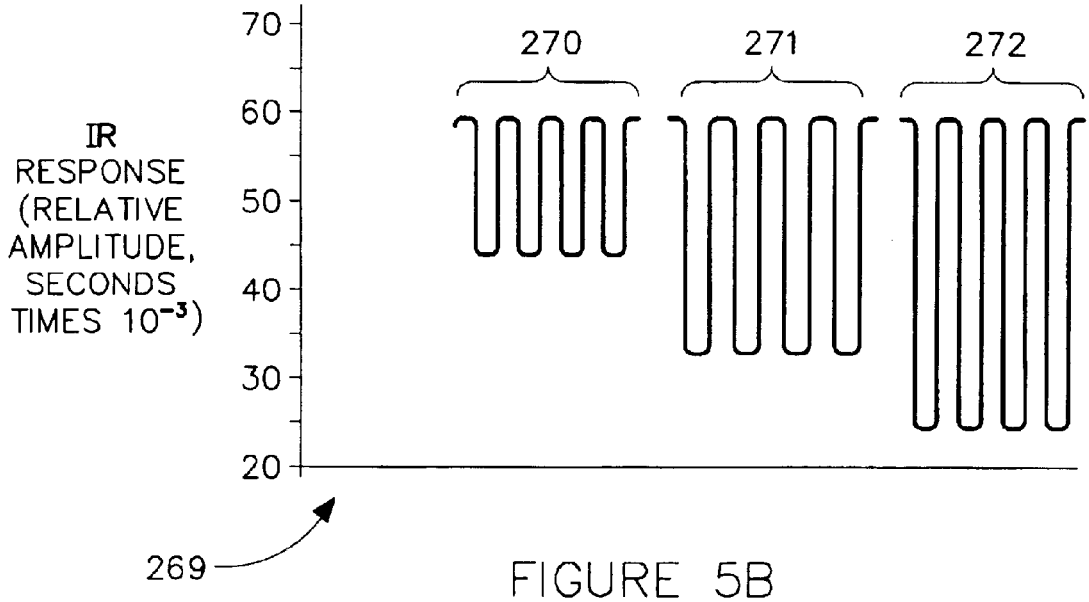
FIG. 5B is a graph of infra red energy emitted by various exposed wafer surfaces that are subject to the CMP processing.
Figure 5C:
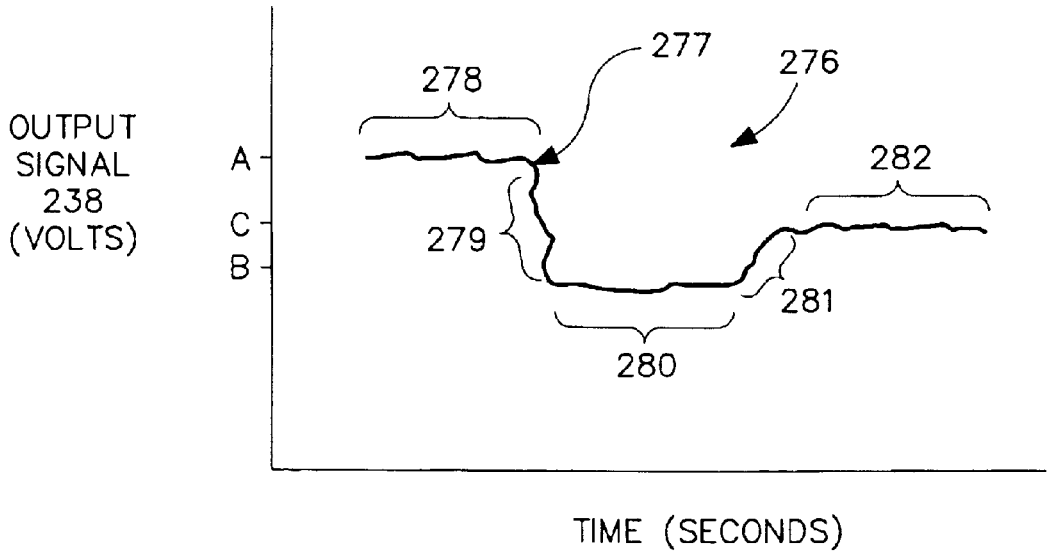
FIG. 5C is a correlation graph illustrating an output of the infra-red temperature sensor representing temperatures of a fluid that is in thermal contact with the backside of the wafer plotted against time during a CMP process performed on the exposed surfaces shown in FIGS. 2B, 2C, 2D, and 2E.

Infra-red (IR) amplitudes are shown in a graph 269 in FIG. 5B to indicate how the temperature of the fluid 266 is related to the various surface properties 210 within the area 202 on the wafer 200. Each of amplitude groups 270, 271 and 272 is based on taking multiple temperature readings. The thermal energy of bare silicon of the wafer 200 undergoing CMP processing is represented by the amplitude group 270 having a relative value of about 0.045 seconds. A unique, different relative value for a cleared wafer 200 having a surface property 210-C (FIG. 2C) is represented by the amplitude group 271 having a relative value of about 0.035 seconds. A further unique, different relative value for an uncleared wafer 200 having a surface property 210-NU is represented by the amplitude group 272 having a relative value of about 0.025 seconds. Thus, for each illustrated surface property 210 there is a unique thermal characteristic that may be used in CMP process control and status determinations. Based on the fluid temperature, the sensor 232 generates the output signal 238. The temperature sensed by the sensor 232 is directly related to the surface property 210 that is being contacted by the pad 209 at a moment of time at which the temperature is sensed, plus the delay time period. For example, a graph 276 shown in FIG. 5C illustrates a curve 277. A high temperature is represented by an output signal 238 having a value A in an exemplary time range 278. The curve 277 has a step function 279 corresponding to a transition, or sudden drop in temperature, represented by an output signal 238 having a value B which continues during a time range 280. The curve 276 illustrates the time range 280 continuing until a step function 281. The step function 281 corresponds to a sudden increase in temperature represented by an output signal 238 having a higher value C that continues during a time range 282. Output signals 238 having the step functions 279 and 281 are output by the temperature sensor 232 during CMP processing of successive ones of the layers 204-UM and 204-DB, for example (FIG. 3E). The output signal 238 thus varies in proportion to the temperatures sensed. By the step function 279 between the range 278 and the range 280, the signal 238 may indicate the transition (see FIGS. 2B and 2C) to the uniform surface property 210-U, for example. By the step function 281 between the time range 280 and the time range 282, the signal 238 may indicate the transition (see FIGS. 2C and 2D) to the clearance of the upper metallization layer 204-U, resulting in the surface properties 210-CUM and 210-NU. The temperature sensed by the sensor 232 may thus indicate the compositional transition, and the clearance transition. Thus, when the sensor 232 outputs the output signal 238 having a sudden increase to the value C, the referenced correlation may indicate that the parameters of the CMP process should be changed to be suitable for processing the diffusion barrier 204-DB.

For temperature sensing purposes, the sensor 232 may be a RAYTEK Model MID, non-contact fixed mount-type temperature sensor, or a thermistor, or a thermocouple. The RAYTEK MID sensor 232, for example, has a sensor head having a diameter of 0.55 inches and a length of about 1.1 inches, which is suitable for being mounted in the cavity 226 of the carrier plate 222. With the sensor 232 mounted in the plate 222 as described, because such mounting places the sensor 232 with the thermal coupling fluid 266 very close to the wafer 200 (as compared to the prior sensor 130 which is remotely located at the connector 145), loss of thermal energy between the interface 212 and the sensor 232 is minimized. The signal-to-noise ratio of the output signal 238 is thus high relative to that of a signal from the prior remote sensor 130.

Other embodiments of the present invention may be provided for sensing a combination of surface properties 210, and transitions, of the exposed surface 208 of the wafers 200. As described above, the area 202 and numerous other areas 202-O may be identified on the exposed surface 208 of the wafer 200. Each such area 202 and other areas 202-O may define the extent of a separate vertical series of exemplary layers 204. Such other vertical series of exemplary layers 204 defined by an area 202-O may have layers 204 differing from the layers 204 defined by the area 202, for example. The combination of surface properties 210 of the exposed surface 208 of the wafers 200 may be sensed at the same time during the same CMP polishing operation performed on the same wafer 200 by suitable design of the system 220 as shown in FIG. 3A. There, one of the cavities 226, and an appropriate one of the sensors 232 housed in each cavity 226, is aligned with each of two exemplary areas 202 and 202-O. Thus, for example, one of the cavities 226 (see cavity 226-1), and an appropriate one of the sensors 232 (see sensor 232-1) may be housed in the cavity 226-1 aligned with the area 202. A separate one of the cavities 226 (see cavity 226-2), and an appropriate separate one of the sensors 232 (see sensor 232-2) may be housed in the cavity 226-2 aligned with the area 202-O. The sensor 232-1 may be any appropriate one of the sensors 232, such as the eddy current sensor or the vibration sensor or the temperature sensor, for example. Similarly, the sensor 232-2 may be any other one of the sensors 232, such as the eddy current sensor or the vibration sensor or the temperature sensor, for example. The location of the aligned area 202 and sensor 232, and the location of the aligned areas 202-O and the respective sensors 232, may define an array of sensors 232 positioned according to the nature and extent of the surface properties 210 that are on, and that are to be formed on, the exposed surface 208 of the wafer 200. One such array is shown in FIG. 3A as including an exemplary three sensors 232-1, 232-2, and 232-3. Each of the sensors 232-1, 232-2 and 232-3 is shown wirelessly transmitting a respective output signal 238-1, 238-2, and 238-3 to a respective signal processor 290-1, 290-2, or 290-3, which provides transition data 292, or quantitative data 294 such as thickness data representing the thickness T, for example. The data 292 or 294 may be input to a CMP process control 296. The control 296 may control the pressure of the plate 222 against the pad 209, or the rotational velocity of the wafer 200, or stop the CMP process when an appropriate process point is reached, for example.

Other embodiments of the present invention are provided for obtaining wafer film property-sensor correlation data, referred to as "correlation data". Such correlation data represents the surface properties 210 of the exposed surface 208 of one or more known semiconductor wafers 200, which are referred to as "correlation wafers" 200C. As described above, the surface properties 210 may result from chemical mechanical polishing treatment performed on the exposed surface 208, such that the surface properties 210 may change during the CMP processing. To facilitate obtaining the correlation data for each property 210 for which correlation data is required, one may use one or more correlation wafers 200C that are known to have a particular surface property 210 at a particular area 202 or 202-O.

Figure 7:
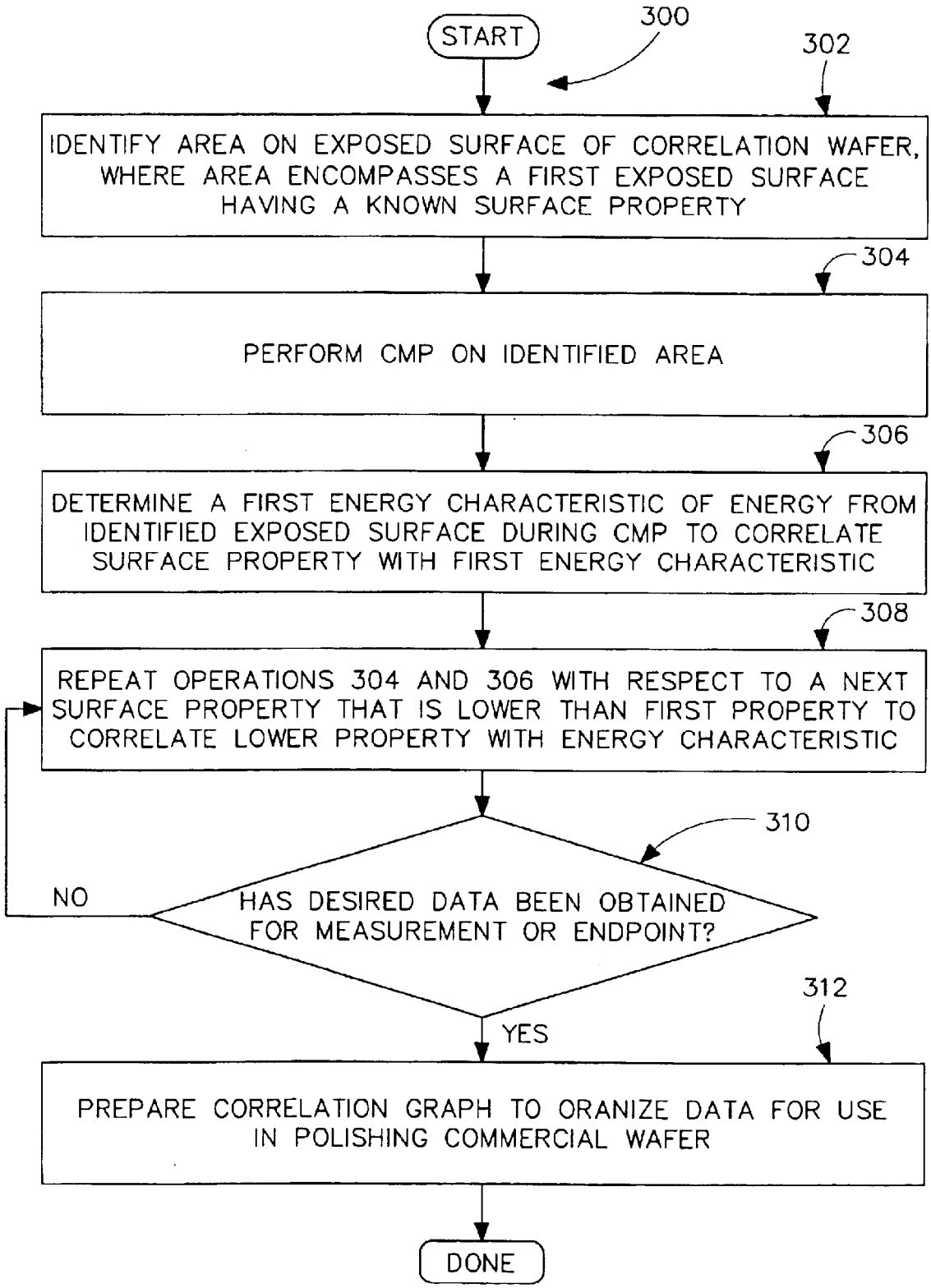
FIG. 7 is a flow chart describing operations used in correlating the sensors shown in FIGS. 3B, 4A, and 5A for preparing the correlation graphs.

Referring to FIG. 7, a method is described in terms of a flow chart 300 for obtaining the correlation data representing such surface properties 210. The method moves to an operation 302 of identifying one of the areas 202 or 202-O on the exposed surface 208 of the correlation wafers 200C. As described, the area 202 or 202-O encompasses an initial known one of the surface properties 210. The method moves to an operation 304 in which a first chemical mechanical polishing operation is conducted on the initial known surface property 210 within the identified area 202, for example, of the calibration wafer 200C. The first chemical mechanical polishing operation is performed using the system 220 having a selected one of the sensors 232. The first chemical mechanical polishing operation is performed according to a preset specification so that the calibration wafer 200C and the production wafers 200 may be subjected to the same CMP processing. The CMP processing causes the initial known surface property 210 to emit the first energy E, which may be any of the electromagnetic inductive coupling, vibration, or thermal energy described above, for example. The method moves to an operation 306 of determining a first energy characteristic of the first energy E emitted during the first chemical mechanical polishing operation. The first energy characteristic may be a first of the output signals 238 from the selected sensor 232, and is unique to the initial known surface property 210 in the defined area 202 during the first chemical mechanical processing operation. The processing of this correlation wafer 200C is stopped. The first output signal 238 is related to the initial known surface property 210 of the exposed surface 208 within the selected area 202. For example, the voltage out of the eddy current sensor 232 may be read and the wafer thickness T corresponding to that voltage may be determined; or the velocity amplitude and frequency of the signal 238 may be determined corresponding to the initial known surface property 210, or the temperature may be measured and related to the voltage of the output signal 238 and the surface property 210 that corresponds to that temperature. The first signal 238 represents one item of wafer film property-sensor correlation data.

The method moves to an operation 308 in which the conducting operation 304 and the determining operation 306 are repeated, for example, with respect to a second correlation wafer 200C that has a lower surface property 210 within the area 202 and under the initial surface property 210. The repeated operation 304 provides a next output of the energy E and the repeated determining operation 306 obtains a next (or second) energy characteristic that is unique to the lower surface property 210. This operation 308 is interrupted. The signal 238 from the sensor 232 obtained during the second operation 306 (a "second" signal 238) is recorded as a next item of wafer film property-sensor correlation data, corresponding to the lower surface property 210.

Figure 6:
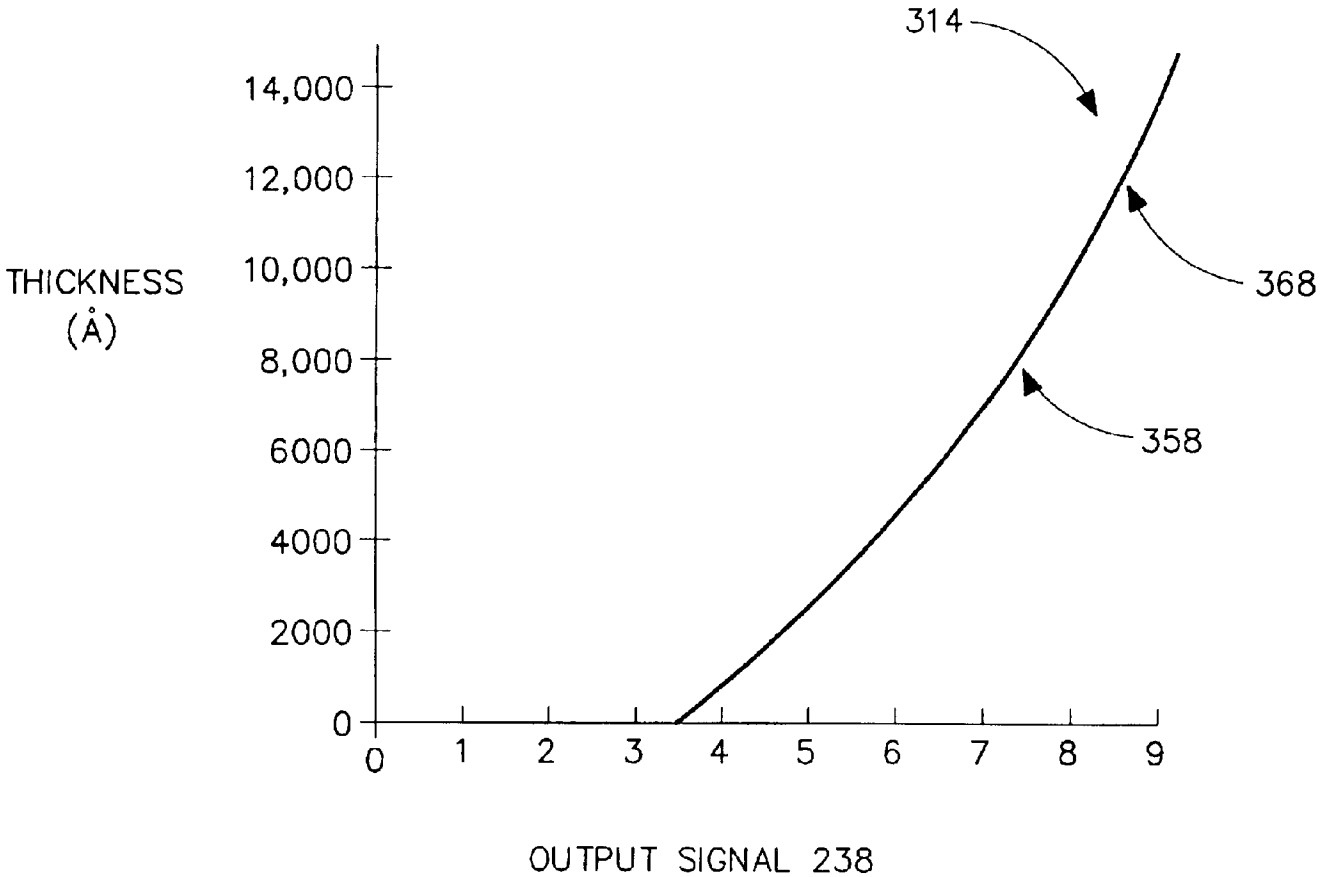
FIG. 6 is a correlation graph derived from use of the eddy current sensor shown in FIGS. 3B and 3C, illustrating the thicknesses of a layer on a wafer plotted against voltages output by the sensor.

The method moves to operation 310 in which a determination is made as to whether sufficient data has been obtained for the exemplary purpose of obtaining the wafer film property-sensor correlation data. If NO, then a loop is taken back to operation 308. In operation 308, the conducting operation 304 and the determining operation 306 are repeated, for example, with respect to a third correlation wafer 200C that has a still lower surface property 210 within the area 202 and under the initial and lower surface properties 210. The repeated operation 304 provides a third output of the energy E and the repeated determining operation 306 obtains a third energy characteristic that is unique to the still lower surface property 210. This operation 308 is interrupted. The signal 238 from the sensor 232 obtained during the third operation 306 is recorded as the third item of wafer film property-sensor correlation data, corresponding to the still lower surface property 210. If operation 310 is answered YES, the method moves to operation 312 in which the correlation data obtained in the operations of flow chart 300 is organized, by the above-described plotting, for example, into any appropriate ones of the graphs 258, 276, and 314 (FIGS. 4B, 5C, and 6, respectively). Each of the graphs 258, 276, and 314, for example, represents the correlation data to be used in operations of the system 220, including of the respective sensors 232, which may next be performed by the method described in reference to FIG. 8 and flow chart 340 with respect to production wafers 200P which are to have the same properties 210 as the correlation wafers 200C.

The following is a more detailed example of the correlation data that may be obtained by performing operations 304 and 306, followed by operation 308. The correlation data may indicate one of the above-described transitions, for example. The transition may be from the surface property 210-U of the upper metallization layer 204-UM (FIG. 2C) to the surface property 210-NU of the diffusion barrier 204-DB (FIG. 2D). The surface property 210-CUM in FIG. 2D represents the clearance of the metallization layer 210-UM. The first energy characteristic obtained by the determination of the first operation 306 may be the above-described first signal 238 correlated to the uniform surface property 210-U of the upper metallization layer 204-UM. The second energy characteristic obtained by the determination of the second determining operation 306 may be the above-described second signal 238 correlated to the non-uniform surface property 210-NU, which correlates to the diffusion barrier 204-DB. With respect to operation 312, the correlation graph to be prepared may be the graph 276 shown in FIG. 5C. The first signal 238 may be at voltage B at the low-voltage end of the step function 281. The second signal 238 may be at voltage C at the high-voltage end of the step function 281. As described above, the first and second signals 238 indicate the transition (see FIG. 2C and FIG. 2D) to the clearance of the upper metallization layer 204-UM and the resulting surface property of the diffusion barrier 204-DB.

The operations of the flow chart 300 may be used with respect to each of the areas 202 and 202-O on the exposed, or front, surface 208 of the calibration wafer 200C. In this manner, there will be correlation of the CMP operations with respect to each of surface property 210 that is encompassed by each of the various areas 202 and 202-O, for the different sensors 232 that may be provided in the various ones of the cavities 226. As a result, the output signals 238 from the various respective sensors 232 may be used for quantitative observations of the status of the CMP operations for each of the surface properties 210. Similarly, the resulting exemplary correlation graphs 258, 276, and 314 may be used in conjunction with those sensors 232 that provide the output signals 238 for determination of the various types of status of the CMP operations for any of the surface properties 210.

Alternatively, the operations of flow chart 300 may be performed on a production wafer 200. In this case, the CMP processing is interrupted more frequently to permit repeated examination of the production wafer 200 and determination as to whether the desired surface property 210 is present at a particular area 202. Once the desired surface property 210 has been obtained by the CMP processing, and once the correlation data has been correlated with such desired surface property 210, operation 308 is performed to obtain the next lower desired surface property 210 of the production wafer 200. The correlation data is then correlated with such next lower desired surface property 210.

Figure 8:
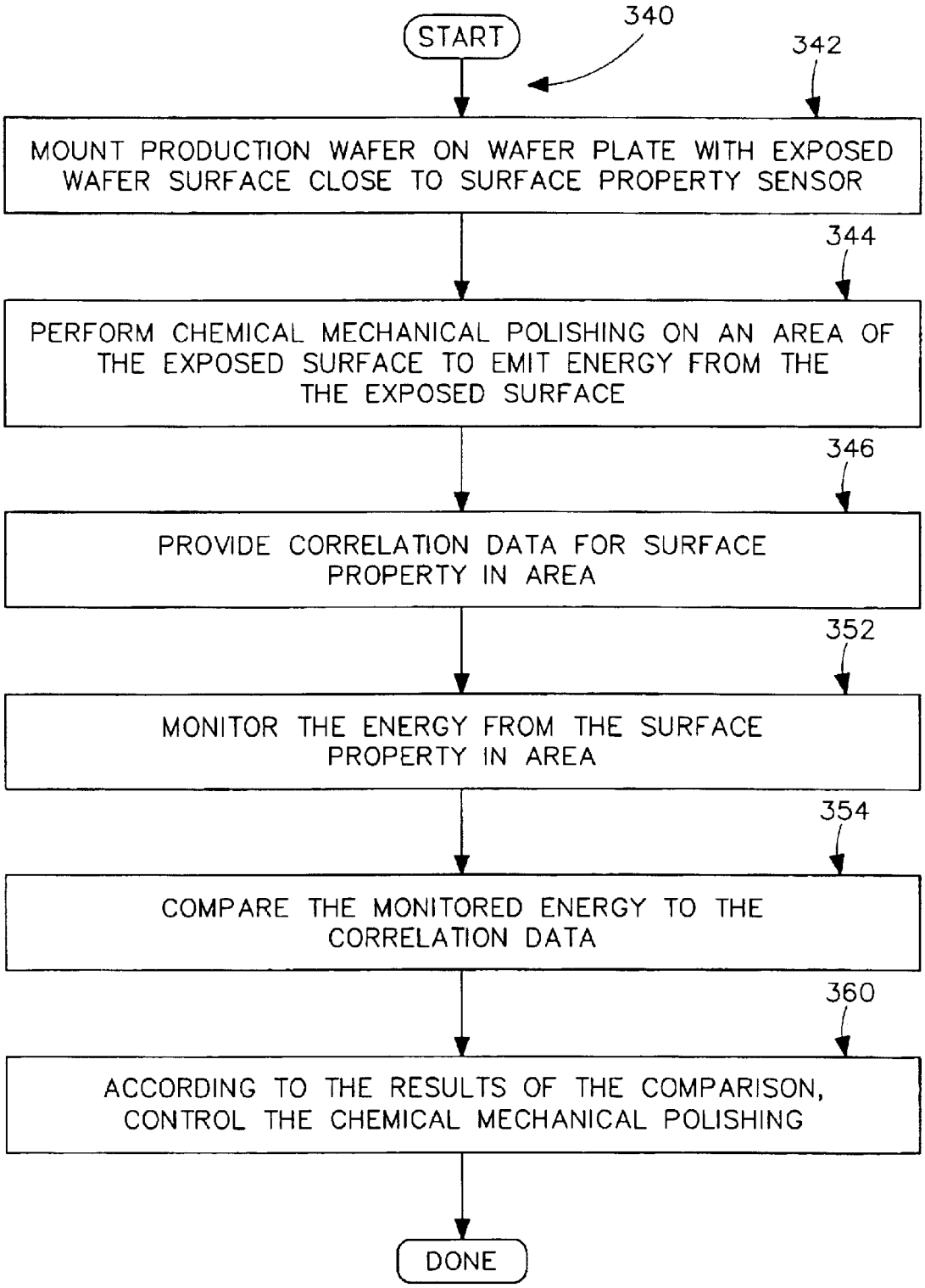
FIG. 8 is a flow chart describing operations in which the correlation graphs shown in FIG. 7 may be used to determine properties of a front side layer during CMP processing.

Other embodiments of the present invention are provided for using the correlation data relating to the surface properties 210 of the exposed surface 208 of the semiconductor wafer 200. As described above, the correlation data may be organized in the form of one or more of the graphs 258, 276, and 314, and may be used during CMP operations performed on the exposed surface 208 of production wafers 200. Referring to FIG. 8, a method is described in terms of a flow chart 340 for controlling the chemical mechanical polishing operations performed on the production wafer 200. The method includes an operation 342 of mounting the production wafer 200 on a carrier head, such as the plate 222. Referring to FIG. 2B, the plate 222 exposes the front surface 208 of the wafer 200 to the polishing pad 209 at the wafer-pad interface 212. The front surface 208 of the wafer 200 and the interface 212 have at least one of the areas 202 or 202-O (FIG. 2A or 3A) under which a plurality of the surface properties 210 are typically located. As to each of the areas 202 or 202-O, the surface properties 210 overlie each other and generally include at least an upper (or outer) surface property (see the property 210-NU in FIG. 2B) initially nearest to the front surface 208 of the wafer 200 that is exposed for the CMP operations. The surface properties 210 also including a final surface property 210-F (FIG. 2E) that is initially spaced furthest from the front surface 208 and toward the backside 206 of the wafer 200. Clearance of the entire overburden 204-O exposes the final surface property 210-F.

The method moves to an operation 344 of performing CMP operations on the area 202 of the exposed surface 208 of the production wafer 200, including on the surface property 210 at the exposed surface 208. During the CMP operations, the polishing pad 209 and the exposed surface 208 interact and cause the energy E to be emitted from the area 202 at the wafer-pad interface 212 according to the surface property 210 at each area 202. The energy E from a particular surface property 210 may have any of the various properties described above, i.e., vibration, thermal, and electromagnetic based on induced eddy currents.

The method moves to an operation 346 in which correlation data is provided in the form of a set of data, which may be one or more of the exemplary correlation graphs 258, 276, and 314 shown in the respective FIGS. 4B, 5C, and 6, for example. Considering the graph 258 (FIG. 4B), the set of data may include, for example, first data 348 corresponding to the energy E emitted during a previous CMP operation performed on a respective one of the surface properties 210 within a corresponding area 202 or 202-O of the correlation wafer 200C that is similar to the production wafer 200. The first data 348 may include, for example, a portion 350 (FIG. 4B) that corresponds to the final surface property 210-F in that area 202 or 202-O of the correlation wafer 200C.

The method moves to an operation 352 of monitoring the energy E emitted from the wafer-pad interface 212 of each various area 202 or 202-O of the production wafer 200 during the CMP operations performed on each respective one of the surface properties 210 of the production wafer 200. The energy E may be monitored, for example, by using the system 220, including one of the sensors 232 with respect to each of those areas 202 or 202-O. The method moves to an operation 354 of comparing the monitored energy E to the first data 348. In detail, the energy E emitted from the respective area 202 or 202-O of the wafer-pad interface 212 of the production wafer 200 during the currently performed CMP operations is compared to the portion 350 of the first data 348 that corresponds to the final surface property 210-F of the correlation wafer 200C. The comparison may be in terms of the output signals 238 from the respective sensors 232 for the respective areas 202 or 202-O, and the corresponding data of the exemplary calibration graph 258, 276, or 314, for example. Referring to the graph 258 (FIG. 4B), for example, the comparison may indicate, for example, that the output signal 232 corresponds to a frequency 356 at which there is a transition of the CMP processing. The transition may be the above-described clearance transition, for example. Or, referring to the graph 314 (FIG. 6), the comparison may indicate, for example, that the output signal 232 corresponds to a point 358 at which there is a corresponding value of the thickness T (e.g., at 8,000 Angstroms) at one of the areas 202. The existence of such exemplary thickness T, for example, may be used for indicating process status, or for process control.

The method moves to a process control operation 360. For example, the currently performed chemical mechanical polishing operations may be interrupted if the CMP process has been completed. In the context of the calibration graph 258 (FIG. 4B), for example, the interruption may be done once the comparing operation 354 determines that the energy E emitted from the area 202 or 202-O during the currently performed chemical mechanical polishing operation is substantially the same as the portion 350 of the first data 348 that corresponds to the final surface property 210-F of the calibration wafer 200C. Frequency 356 indicates that the desired surface property 210 has been obtained.

In more detail, the flow chart 340 may be used, for example, when at least one of the surface properties 210 includes a non-uniform patterned structure 210-NUP and at least another one of the surface properties 210 includes a uniform topographical configuration 210-U. In this exemplary situation, the operation 346 of providing the set of data may include providing the graph 258 (FIG. 4B) having the one portion, or set, 350 of data corresponding to the patterned property 210-P (of the metallization layer 204-UM) and providing one portion (or set) of data 364 corresponding to the uniform topographical property 210-U. Referring to FIG. 4B, the one portion (or set) 350 of data corresponding to the patterned structure may include the vibrational amplitude vs. frequency energy characteristic that is substantially different from a vibrational amplitude vs. frequency energy characteristic of the set 364 of data corresponding to the uniform topographical property 210-U. That is, the peak 264 provides the substantial difference. As noted above, the portion (or set) 350 of data may be used to determine that the desired property 210 has been obtained.

In another example, by reference to FIGS. 3D, 3E, and 6, it may be understood that the flow chart 340 may be used when at least one of the surface properties 210 includes a first topography 210-T1 having a thickness T1 that is different from a thickness T2 corresponding to a second topography 210-T2. In this situation, the operation 346 of providing correlation data may provide the data as a first thickness value 368 corresponding to the first topography 210-T1 and as the smaller thickness value 358 corresponding to the second topography 210-T2. It may be understood that the first thickness value 368 quantitatively represents the thickness T1 of the first topography 210-T1 and the smaller thickness value 358 quantitatively represents the thickness T2 of the second topography 210-T2.

In another example, by reference to FIGS. 2B, 2C, 2D, and 5C, it may be understood that the flow chart 340 may be used when at least one of the surface properties 210 includes a first non-uniform topography 210-NU (FIG. 2B) that is different from a second topography having a uniform topography 210-U (FIG. 2C). In this situation, the operation 346 may provide the correlation data as a first value A of the range 278, which may correspond to the first non-uniform topography 210-NU, and as a value B of the range 280 which may correspond to the second topography 210-U.

In review, the methods of the present invention detect surface properties 210, and transitions of the surface properties 210, of exposed surfaces 208 of wafers 200 in chemical mechanical polishing for CMP process status and control. Such methods avoid the limitations of optical systems that view the wafer through the polishing pad. By placing the sensors 232 in the plate 222 with the wafer 200 mounted on the plate 222, so that the sensors 232 always "see" the respective areas 202 of the wafer 200, the present need is met by constantly detecting the surface properties 210 and transitions of the surface properties 210 of the exposed surfaces 208 of the wafers 200. Further, by placing the sensors 232 co-extensive with the wafer mounting surface 224, or within about 2 mm. of such surface 224, the present invention meets the need for CMP process status and control methods in which the surface properties 210, and transitions of the surface properties 210, of the wafer surface 208 are sensed at a location at a proximate edge of the wafer mounting surface 224, or within, the wafer carrier plate 222, rather than remotely as in the prior remote vibration sensors. Further, by the variety of sensors 232 that may be received in the plate 222, the present invention also meets the need for such sensing of the wafer surface properties 210, including sensing of the transitions of the surface properties 210, in chemical mechanical polishing for CMP process status and control. By providing the vibration sensor 232 in the plate 222 close to the wafer-pad interface 212 the present invention meets the related need to provide an improved way of sensing vibrations that are based on the CMP process. Such improved way avoids dampening of the process-based vibrations before such vibrations are sensed, which results in strong reception of the process vibrations in comparison to vibrations based on the physical properties of the structure, provides a gain in resolution, and improves the signal-to-noise ratio of the output signals 238 with respect to the process vibrations. In addition, by allowing many sensors 232 to be placed across the exposed surface 208 of the wafer 200, the need is met for sensing of relatively large, or wide-area, wafer surfaces 208 in chemical mechanical polishing for CMP process status and control, as compared to the relatively small wafer surface areas sensed by the in-situ sensors, for example.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method of obtaining correlation data representing properties of exposed surfaces of a semiconductor wafer, wherein processing operations performed on the wafer expose the exposed surfaces in succession, the exposed surfaces including an initial exposed surface of an initial layer of the wafer and an underlying exposed surface of an underlying layer of the wafer that is under the initial layer, wherein the exposed surfaces have different surface properties, the method comprising the operations of:

identifying an area on the exposed surface of the initial layer of a first correlation wafer, the exposed surface area of the initial wafer having an initial surface property;

conducting a first processing operation on the exposed surface of the initial layer of the first correlation wafer, the first processing operation causing the exposed surface of the initial layer of the first correlation wafer to emit a first energy output;

determining a first energy characteristic of the first energy output emitted during the first processing operation, the first energy characteristic being unique to the initial surface property during the first processing operation; and repeating the conducting and determining operations with respect to a second correlation wafer having at least one of the underlying layers, the at least one of the underlying layers having a lower surface property within the area, the repeated conducting operation causing the exposed surface of the at least one underlying layer to emit at least one next energy output, the repeated determining operation determining at least one next energy characteristic that is unique to the lower surface property.

2. A method as recited in claim 1, comprising the further operation of:

organizing the first energy characteristic and the at least one next energy characteristic in terms of two variables, one of the variables representing the surface property and the other of the variables representing data obtained during the respective processing operations.

3. A method as recited in claim 1, wherein:

the first and next energy outputs are proportional to a thickness property of the correlation wafers under the exposed surface; and the determining operations result in the first and at least one next energy characteristics representing the thickness property of the correlation wafers under the exposed surface.

4. A method as recited in claim 1, wherein:

the first and at least one next energy outputs are proportional to the uniformity of the respective exposed surfaces within the area; and the determining operations result in the first and at least one next energy characteristics representing the degree of uniformity of the respective exposed surfaces within the area.

5. A method as recited in claim 1, wherein a different surface property of the underlying layer within the area comprises a patterned layer, and the initial layer having the initial surface property is an overburden layer, wherein the overburden layer is to be cleared during the processing operations; and wherein:

the at least one next energy output has an amplitude vs. frequency property that is unique to the patterned layer; and one of the repeated determining operations results in the at least one next energy characteristic in the form of amplitude vs. frequency data that is unique to the patterned layer.

6. A method as recited in claim 1, wherein the initial layer of the first correlation wafer has the initial exposed surface having a first shape that is other than flat and by the processing operations the shape of the underlying exposed surface of the underlying layer next under the initial layer is to become a second shape that is flat, the method comprising the further operations of:

after conducting the first processing operation on the initial exposed surface having the first shape, and after the operation of determining the first energy characteristic, the repeating of the conducting operation being by conducting a second processing operation on the area of the first correlation wafer to cause the underlying exposed surface within the area to the second shape, the second processing operation causing the underlying exposed surface having the second shape to generate the at least one next energy output; and the repeating of the determining operation being by determining the at least one next energy characteristic as being unique to the surface property of the second shape.

7. A method as recited in claim 1, wherein:

each of the determining operations comprises sensing the respective first and at least one next energy outputs at a location spaced no more than about 2 mm. from a portion of a backside of the wafer as the wafer is being subjected to the respective processing operation, the portion of the backside being directly opposite to the identified area of the wafer that is subjected to the respective processing operations.

8. A method as recited in claim 1, wherein:

each of the processing operations is a chemical mechanical polishing operation.

9. A method of controlling processing operations performed on a production wafer, the method comprising the operations of:

mounting the production wafer on a carrier head that exposes a front surface of the wafer to a processing pad at a wafer-pad interface, the front surface of the wafer and the interface having at least one area under which a plurality of wafer configurations are located, the wafer configurations overlying each other and including at least an upper wafer configuration initially nearest to the front surface of the wafer that is exposed for the processing operations, the upper wafer configuration having an upper surface configuration, the wafer configurations also including a final surface configuration initially spaced furthest from the front surface and toward a backside of the wafer;

performing processing operations on the area of the production wafer so that energy is emitted from a portion of the upper surface configuration that is within the area of the wafer-pad interface;

providing a set of data, the set of data including first data corresponding to energy emitted during a previous processing operation performed on each respective one of the surface configurations within a corresponding area of a correlation wafer that is similar to the production wafer, the first data including final data portion that corresponds to the final surface configuration of the correlation wafer;

monitoring the energy emitted from portions of the surface configuration that are within the area on the production wafer during the processing operations performed on each respective one of the surface configurations of the production wafer;

comparing the energy emitted from the respective portions of the production wafer during the currently performed processing operations, the comparing being with respect to the final data corresponding to the processing of the final surface configuration of the correlation wafer; and interrupting the currently performed processing operations once the comparing operation determines that the energy emitted from that portion of the production wafer during the currently performed processing operation is substantially the same as the final data.

10. A method as recited in claim 9, wherein at least one of the surface configurations comprises non-uniform patterned structure and at least another one of the surface configurations comprises a uniform topographical configuration, and wherein:

the operation of providing the set of data includes providing one set of data corresponding to the patterned structure and providing one set of data corresponding to the uniform topographical configuration; and the one set of data corresponding to the patterned structure includes a vibrational amplitude vs. frequency characteristic that is substantially different from a vibrational amplitude vs. frequency characteristic corresponding to the uniform topographical configuration.

11. A method as recited in claim 9, wherein at least one of the surface configurations comprises a first topography having a first thickness measured from the surface of the wafer that is different from a second thickness measured from the surface of the wafer to a second topography; and wherein:

the operation of providing the set of data includes providing a first set of data corresponding to the first topography and providing a second set of data corresponding to the second topography; and the first set of data includes data quantitatively representing the first thickness of the first topography and the second set of data includes data quantitatively representing the second thickness of the second topography.

12. A method as recited in claim 9, wherein at least one of the surface configurations comprises a non-uniform topography and at least another one of the surface configurations comprises a substantially flat topography, and wherein:

the operation of providing the set of data includes providing a first set of data corresponding to the non-uniform topography and providing a second set of data corresponding to the substantially flat topography; and the first set of data includes data quantitatively representing the thickness of the wafer under the area having the non-uniform topography and the second set of data includes data quantitatively representing the thickness of the wafer under the area having the substantially flat topography.

13. A method of obtaining correlation data representing properties of an exposed surface of a semiconductor wafer, wherein the surface properties result from chemical mechanical polishing operations performed on the exposed surface, the exposed surface having a variable surface property that varies according to characteristics of an initial wafer layer and layers underlying the initial wafer layer, the operations being effective to successively remove the initial layer to expose at least one of the underlying layers, the method comprising the operations of:

identifying an area on the exposed surface of a first correlation wafer, the area encompassing part of the exposed surface of the initial layer having an initial one of the surface properties;

conducting a first chemical mechanical polishing operation on the exposed surface of the initial layer within the area of the first correlation wafer, the first chemical mechanical polishing operation causing the exposed surface of the initial layer to emit a first energy output according to a characteristic of the surface property of the initial layer;

determining a first energy characteristic of the first energy output, the first energy characteristic being unique to the characteristic of the surface property of the initial layer; and repeating the conducting and determining operations with respect to an exposed surface of an underlying layer of a second correlation wafer and within the area, the underlying layer having an underlying surface property, the repeated conducting and determining operations causing the exposed surface of the underlying layer to emit a next energy output and determining a next energy property that is unique to the underlying surface property.

14. A method as recited in claim 13, wherein each of the first and next energy outputs results from energy emitted from the area of respective wafer-chemical mechanical polishing pad interfaces of the respective first and second correlation wafers, the energy being in the form of electromagnetic energy inductively coupled to a sensor located very close to the respective wafer-pad interfaces.

15. A method as recited in claim 14, wherein the first and next energy outputs are based on eddy current-based data quantitatively representing the thickness of the respective first and second correlation wafers.

16. A method of controlling chemical mechanical polishing operations performed on a production wafer, the method comprising the operations of:

mounting the production wafer on a carrier head that exposes a front surface of the wafer to a polishing pad at a wafer-pad interface, the front surface of the wafer and the interface having at least one area under which a plurality of wafer configurations are located, the wafer configurations overlying each other and including at least an upper surface configuration initially nearest to the front surface of the wafer, the upper surface configuration being initially exposed for the chemical mechanical polishing operations, the wafer configurations also including a final surface configuration initially spaced away from the upper surface configuration toward a backside of the wafer;

performing chemical mechanical polishing operations on the upper surface configuration within the area of the wafer so that energy emitted from the area of the wafer is related to the surface configurations of the production wafer;

providing a first set of data, the first set of data including first data corresponding to energy emitted during a previous chemical mechanical polishing operation performed on each respective one of the surface configurations within a corresponding area of a correlation wafer that is similar to the production wafer, the first set of data including final correlation data that corresponds to the final surface configuration of the correlation wafer;

monitoring the energy emitted from the area of the production wafer during the chemical mechanical polishing operations performed on each respective one of the surface configurations of the production wafer to provide a second set of data;

comparing the energy emitted from the area of the production wafer during the currently performed chemical mechanical polishing operations to the final correlation data; and interrupting the currently performed processing operations once the comparing operation determines that the energy emitted from the area during the currently performed chemical mechanical polishing operation is substantially the same as the final correlation data.

17. A method as recited in claim 16, wherein each of the first and second sets of data results from the energy emitted from the area of the wafer being in the form of electromagnetic energy inductively coupled to a sensor located very close to the wafer-pad interface.

* * * * *